US010138086B2

(12) United States Patent
Wada et al.

(10) Patent No.: US 10,138,086 B2
(45) Date of Patent: Nov. 27, 2018

(54) PAPER SHEET HANDLING APPARATUS

(71) Applicant: FUJITSU FRONTECH LIMITED, Inagi (JP)

(72) Inventors: Takashi Wada, Inagi (JP); Satoshi Hayashi, Inagi (JP); Yuji Tanaka, Inagi (JP); Katsuo Takahashi, Inagi (JP); Hayato Minamishin, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 15/679,678

(22) Filed: Aug. 17, 2017

(65) Prior Publication Data

US 2017/0345244 A1 Nov. 30, 2017

Related U.S. Application Data

(63) Continuation of application No. PCT/JP2015/058090, filed on Mar. 18, 2015.

(51) Int. Cl.
*B65H 7/18* (2006.01)
*B65H 1/14* (2006.01)
(Continued)

(52) U.S. Cl.
CPC ..... *B65H 7/18* (2013.01); *B65H 1/14* (2013.01); *B65H 1/26* (2013.01); *B65H 7/02* (2013.01);
(Continued)

(58) Field of Classification Search
CPC ... B65H 1/04; B65H 1/08; B65H 1/14; B65H 1/18; B65H 1/20; B65H 3/06; B65H 7/00;
(Continued)

(56) References Cited

U.S. PATENT DOCUMENTS

2001/0017440 A1* 8/2001 Minamishin ..... B65H 1/14 271/10.11
2010/0102505 A1* 4/2010 Ikeuchi ..... B65H 1/14 271/262
2017/0313532 A1* 11/2017 Kawase ..... B65H 3/52

FOREIGN PATENT DOCUMENTS

JP 2-225240 9/1990
JP 5-303674 11/1993
(Continued)

OTHER PUBLICATIONS

International Search Report dated Jun. 16, 2015 in corresponding International Patent Application No. PCT/JP2015/058090.
(Continued)

*Primary Examiner* — Prasad V Gokhale
(74) *Attorney, Agent, or Firm* — Staas & Halsey LLP

(57) ABSTRACT

A paper sheet handling apparatus has a pickup roller, a stage, a pressure sensor, and a measuring unit. For each feeding process, in which the pickup roller feeds paper sheets until the pressure detected by the pressure sensor becomes less than a predetermined set value, the stage presses paper sheets against the pickup roller until the pressure detected by the pressure sensor reaches another set value. The pickup roller operates at a feeding speed of a first speed if a calculated feeding value is less than a threshold, and operates at a feeding speed of a second speed that is slower than the first speed if the calculated feeding value is equal to or greater than the threshold, the calculated feeding value being calculated based on: the amount of movement of the stage measured by the measuring unit; and the number of paper sheets fed by the feeding process.

11 Claims, 13 Drawing Sheets

(51) Int. Cl.

| | |
|---|---|
| ***G07D 9/00*** | (2006.01) |
| ***B65H 1/26*** | (2006.01) |
| ***B65H 7/02*** | (2006.01) |
| ***G07D 11/00*** | (2006.01) |

(52) U.S. Cl.
CPC ..... *G07D 9/00* (2013.01); *G07D 11/0021* (2013.01); *B65H 2511/152* (2013.01); *B65H 2513/10* (2013.01); *B65H 2701/1912* (2013.01)

(58) Field of Classification Search
CPC ... B65H 7/02; B65H 7/14; B65H 7/18; B65H 7/20; B65H 2511/152; B65H 2513/10; B65H 2513/102; B65H 2513/104; B65H 2701/1912
See application file for complete search history.

(56) References Cited

FOREIGN PATENT DOCUMENTS

| | | |
|---|---|---|
| JP | 10-134225 | 5/1998 |
| JP | 2005-215882 | 8/2005 |
| JP | 2005-259087 | 9/2005 |
| JP | 2013-11980 | 1/2013 |

OTHER PUBLICATIONS

Written Opinion of the International Search Authority dated Jun. 16, 2015 in corresponding International Patent Application No. PCT/JP2015/058090.

* cited by examiner

PAPER SHEET HANDLING APPARATUS

CROSS-REFERENCE TO RELATED APPLICATION

This application is a continuation application of International Application PCT/JP2015/058090, filed on Mar. 18, 2015, the entire contents of which are incorporated herein by reference.

FIELD

The embodiments discussed herein are directed to a paper sheet handling apparatus.

BACKGROUND

Conventionally, for feeding paper currency bills from a cassette storing therein the paper currency bills as paper sheets; a stage, on which the paper currency bills in the cassette are accumulated, is lifted up. By a bundle of the paper currency bills being pressed with appropriate pressure, against a pick roller, which is provided at an upper portion in the cassette and feeds the paper currency bills, the paper currency bills are fed at a constant speed. Such a conveying method has been used. In order to control lifting of a stage in such a technique for feeding and conveying paper currency bills, the lifting is started if pressure detected by a pressure sensor installed at a pickup roller becomes less than a proper range that has been prescribed when one or more paper currency bills have been fed. If the pressure reaches a predetermined value in the proper range, the lifting is stopped. Such feedback control has been used.

Further, in recent years, a technique has been provided, in which plural conveyance speed modes, such as a normal conveyance mode and a high speed conveyance mode, are set beforehand in order to increase conveyance speed of paper currency bills and shorten paper currency bill handling time.

Patent Literature 1: Japanese Unexamined Patent Application Publication No. 05-303674

Patent Literature 2: Japanese Unexamined Patent Application Publication No. 2005-259087

However, when the conveyance speed of paper currency bills is increased, so-called largely damaged paper currency bills, which are paper currency bills that are crumpled and low in stiffness, become susceptible to the increase in the conveyance speed. As a result, the possibility of occurrence of damage to the paper currency bills or a conveyance jam is increased. Therefore, unless the state of the accumulated paper currency bills is known beforehand, the conveyance speed of paper currency bills is difficult to be increased.

SUMMARY

According to an aspect of an embodiment, a paper sheet handling apparatus includes, a feeding unit that feeds paper sheets by rotating, a placement unit, on which the paper sheets are layered over one another and accumulated in a thickness direction, and which presses the paper sheets against the feeding unit by moving in a layering direction of the paper sheets, a detection unit that detects pressure applied on the feeding unit due to movement of the placement unit, and a measuring unit that measures amount of movement of the placement unit, wherein for each feeding process, in which the feeding unit feeds the paper sheets until the pressure detected by the detection unit becomes less than a predetermined set value, the placement unit presses the paper sheets against the feeding unit until the pressure detected by the detection unit reaches another set value, and the feeding unit operates at the feeding speed of a first speed if a calculated feeding value is less than a predetermined threshold for calculated feeding value, and operates at the feeding speed of a second speed that is slower than the first speed if the calculated feeding value is equal to or greater than the predetermined threshold for calculated feeding value, the calculated feeding value being calculated based on: the amount of movement of the placement unit measured by the measuring unit after the feeding process and the number of fed sheets that is the number of paper sheets fed by the feeding process.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Hereinafter, embodiments of a paper sheet handling apparatus disclosed by the present application will be described, based on the drawings. Hereinafter, a case where a paper sheet handling apparatus is used as an automated teller machine (ATM) that handles paper currency bills as paper sheets will be described as an example. However, paper sheet handling apparatuses disclosed by the present application are not limited by the following embodiments, and the paper sheet handling apparatuses include any of various apparatuses each having, for example, a bill recycle unit (BRU) or a bill dispenser unit (BDU). Further, the paper sheet handling apparatuses include a printer or the like that executes printing with paper being a medium. In the respective embodiments, the same signs will be appended to configurations having the same functions, and redundant description thereof will be omitted.

First Embodiment

Figure 2:
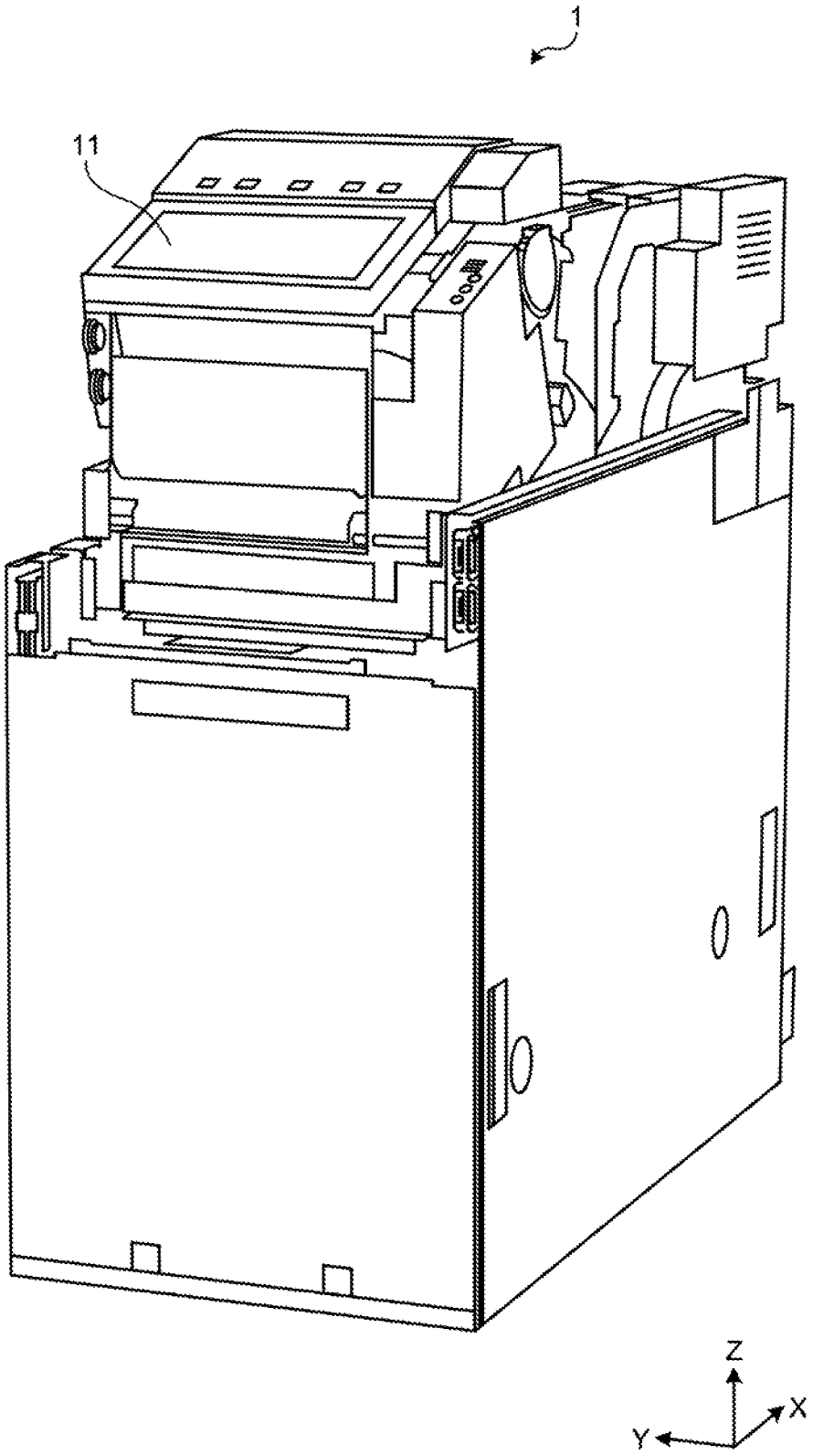
FIG. 2 is a diagram illustrating an external view of a paper sheet handling apparatus according to the first embodiment.

Hereinafter, a paper sheet handling apparatus 1 according to a first embodiment of the present invention will be described, based on the drawings. First of all, an overall configuration of the paper sheet handling apparatus 1 will be described by use of FIG. 2 and FIG. 3. FIG. 2 is a diagram illustrating an external view of the paper sheet handling apparatus according to the first embodiment. In the example illustrated in FIG. 2, the paper sheet handling apparatus 1 has a paper currency bill deposit and withdrawal port 11.

Figure 3:
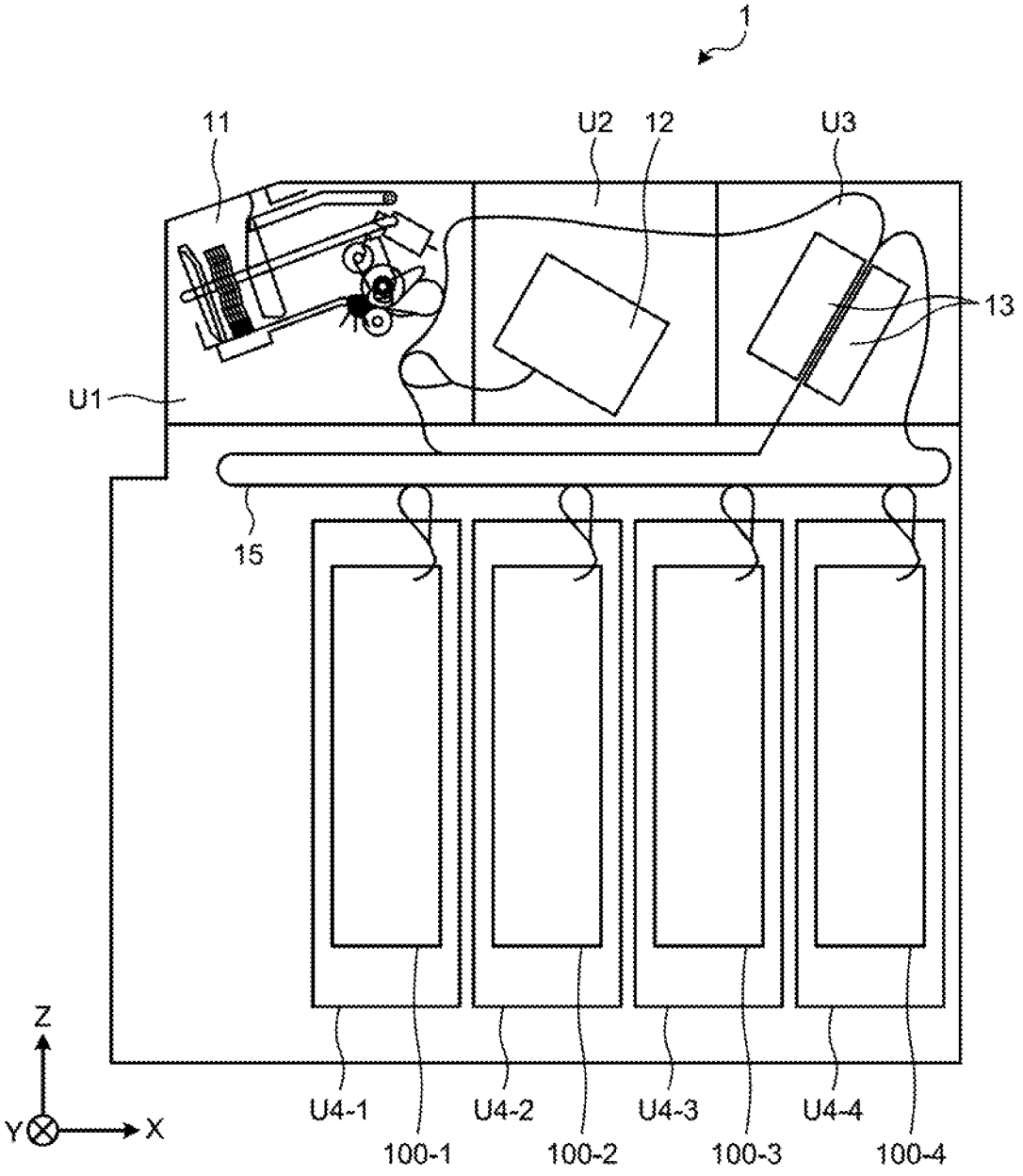
FIG. 3 is a diagram illustrating an example of a configuration of the paper sheet handling apparatus according to the first embodiment.

FIG. 3 is a diagram illustrating an example of a configuration of the paper sheet handling apparatus according to the first embodiment. FIG. 3 is a sectional side view. In FIG. 3, the paper sheet handling apparatus 1 has respective units, which are units U1, U2, U3, and U4-1 to U4-4. The unit U1 is a deposit and withdrawal unit having the paper currency bill deposit and withdrawal port 11. The unit U2 is a temporary holding unit having a temporary holding portion 12. The unit U3 is a discriminating unit having a paper currency bill discriminator 13. The units U4-1 to U4-4 are cassette units respectively having cassettes 100-1 to 100-4. For example: 10000-yen bills are stored in the cassette 100-1; 5000-yen bills are stored in the cassette 100-2; 2000-yen bills are stored in the cassette 100-3; and 1000-yen bills are stored in the cassette 100-4. Hereinafter, when the cassettes 100-1 to 100-4 are described without particular distinction among them, they will be referred to as cassettes 100.

In the paper sheet handling apparatus 1, after passing through a conveyance path 15, and being conveyed to the paper currency bill discriminator 13 and subjected to discrimination, paper currency bills deposited into the paper currency bill deposit and withdrawal port 11 are temporarily accumulated in the temporary holding portion 12. If a counterfeit bill is not included in the deposited paper currency bills as a result of the discrimination by the paper currency bill discriminator 13, the paper currency bills accumulated in the temporary holding portion 12 are conveyed from the temporary holding portion 12 through the conveyance path 15. According to denominations of the paper currency bills, the paper currency bills are respectively stored in any of the cassettes 100-1 to 100-4. On the contrary, if a counterfeit bill is included in the deposited paper currency bills, the paper currency bills accumulated in the temporary holding portion 12 are returned to the paper currency bill deposit and withdrawal port 11 through the conveyance path 15.

Further, in the paper sheet handling apparatus 1, when money is withdrawn, according to a withdrawal amount specified by a customer, paper currency bills are fed from the respective cassettes 100. The fed paper currency bills pass through the conveyance path 15 and are temporarily accumulated in the temporary holding portion 12. When all of the paper currency bills according to the withdrawal amount have been accumulated in the temporary holding portion 12, the accumulated paper currency bills pass through the conveyance path 15 and are withdrawn from the paper currency bill deposit and withdrawal port 11.

Figure 4:
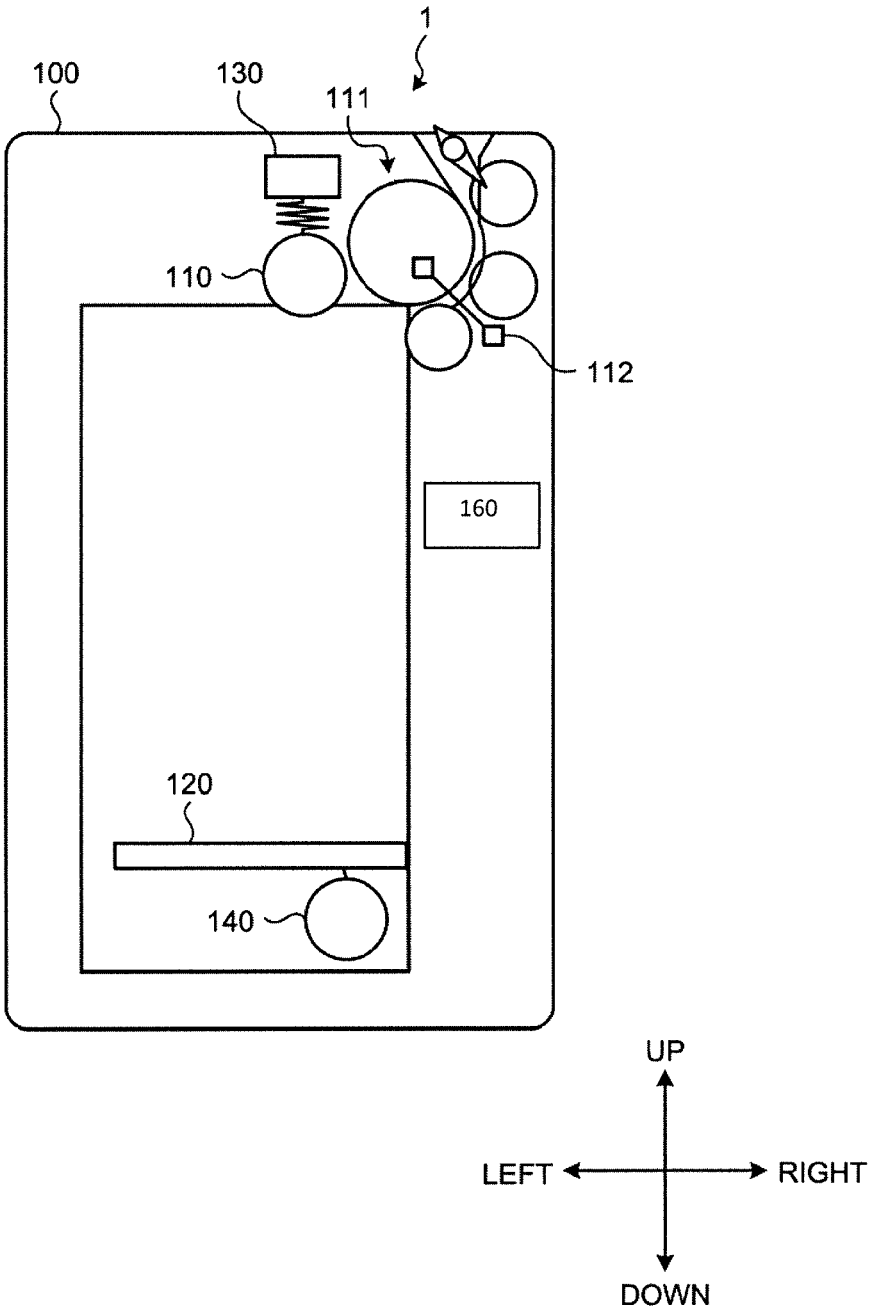
FIG. 4 is a diagram illustrating an example of an outline of a cassette according to the first embodiment.

In the paper sheet handling apparatus 1, speed, at which paper currency bills are fed from the cassette 100, is changed according to a state of the paper currency bills. This point will be described based on the drawings. Firstly, an outline of a configuration of the cassette 100 will be described by use of FIG. 4. FIG. 4 is a diagram illustrating an example of an outline of the cassette according to the first embodiment.

In the cassette 100, a feeding unit, a placement unit, a detection unit, and a measuring unit 160 are provided. In the example illustrated in FIG. 4, the feeding unit is a pickup roller 110 that feeds paper currency bills by rotating. The pickup roller 110 feeds paper currency bills by being driven and rotated by a predetermined motor or the like. Hereinafter, speed, at which the pickup roller 110 feeds the paper currency bills, may be referred to as feeding speed.

Further, in the example illustrated in FIG. 4, the placement unit is a stage 120 that is movable in a layering direction of the paper currency bills. A feeding direction is an up-down direction in FIG. 4. The stage 120 is made movable by a predetermined driving mechanism, for example, a stepping motor or the like. For example, on the stage 120, paper currency bills are layered over one another and accumulated in a thickness direction. By moving in the layering direction of the paper currency bills, the stage 120 presses the paper currency bills against the pickup roller 110. Hereinafter, the up-down direction in FIG. 4 will be referred to as an up-down direction.

Further, in the example illustrated in FIG. 4, the detection unit is a pressure sensor 130 that detects pressure applied on the pickup roller 110. For example, the pressure sensor 130 detects pressure applied on the pickup roller 110 due to the movement of the stage 120.

Further, in the example illustrated in FIG. 4, the measuring unit 160 measures the amount of movement of the stage 120 by use of a predetermined means. In the example illustrated in FIG. 4, a driving mechanism 140 has: the stepping motor; and the measuring unit 160 that measures, based on the amount of driving by the stepping motor, the amount of movement of the stage 120. For example, the measuring unit 160 of the driving mechanism 140 measures the amount of movement of the stage 120 by conversion from the number of steps input to the stepping motor. The stepping motor and the measuring unit 160 may be configured separately from each other. Furthermore, as long as the amount of movement of the stage 120 is measurable, the measuring unit 160 may have any configuration.

Further, in the example illustrated in FIG. 4, to where the paper currency bills are fed from the pickup roller 110, a feeding mechanism 111 is provided, based on the feeding speed of the pickup roller 110. The paper currency bills are fed rightward in FIG. 4. For example, paper currency bills, which are fed by the pickup roller 110 and the feeding mechanism 111, pass through the conveyance path 15 and are accumulated in the temporary holding portion 12. Therefore, in the paper sheet handling apparatus 1, conveyance speed of paper currency bills is determined according to the feeding speed of the pickup roller 110. That is, in the paper sheet handling apparatus 1, the more increased the feeding speed of the pickup roller 110 is, the more increased the conveyance speed of paper currency bills is able to be.

Further, in the example illustrated in FIG. 4, at a position intersecting the feeding direction of paper currency bills, the position being where the feeding mechanism 111 is provided, an optical sensor 112 for jam detection is provided. In this embodiment, the optical sensor 112 is used for counting the number of fed paper currency bills. For example, the optical sensor 112 counts the number of times light output by the optical sensor 112 has been intercepted, as the number of fed paper currency bills. The example illustrated in FIG. 4 is an example where the optical sensor 112 for jam detection is used in counting the number of fed paper currency bills, but as long as the number of fed paper currency bills is countable, the number of fed paper currency bills may be counted by any of various means, not being limited to the optical sensor 112.

The paper sheet handling apparatus 1 may include a control unit that controls the whole paper sheet handling apparatus 1. In this case, based on information obtained from the pressure sensor 130, the driving mechanism 140, and the optical sensor 112, the control unit may control the feeding speed of the pickup roller 110, the movement of the stage 120, and the like. For example, the control unit may count, based on the information obtained from the optical sensor 112, the number of fed paper currency bills. Further, the control unit may change the feeding speed of the pickup roller 110. The paper sheet handling apparatus 1 may include a control unit for each of the cassettes 100, or may include a control unit that controls all of the cassettes 100. Furthermore, each component of the paper sheet handling apparatus 1, for example, each of the pickup roller 110, the driving mechanism 140, the optical sensor 112, and the like has a control unit. Each component of the paper sheet handling apparatus 1 may operate based on information obtained from another component.

If the fed paper currency bills are, for example, paper currency bills that are close to new bills with little damage (which may, hereinafter, be referred to as "less damaged paper currency bills"), the feeding speed of the pickup roller 110 is able to be set to a high speed. On the contrary, if the fed paper currency bills are so-called largely damaged paper currency bills, which are paper currency bills that are crumpled and low in stiffness (which may, hereinafter, be referred to as "largely damaged paper currency bills"), the feeding speed of the pickup roller 110 is set to a low speed in order to prevent damage to the paper currency bills and conveyance jams from occurring. Therefore, in the paper sheet handling apparatus 1, based on the state of the fed paper currency bills, the conveyance speed of the pickup roller 110 is changed.

Thickness of a largely damaged paper currency bill is thicker than thickness of a less damaged paper currency bill. For example, in accumulated paper currency bills, a thickness occupied by a single paper currency bill is thin if the accumulated paper currency bills are less damaged paper currency bills and is thick if the accumulated paper currency bills are largely damaged paper currency bills. Therefore, in the paper sheet handling apparatus 1, based on information related to thickness of the paper currency bills, the conveyance speed of the pickup roller 110 is changed.

Change of the feeding speed of the pickup roller 110 described below is executed for every process (which may, hereinafter, be referred to as a "feeding process), in which the pickup roller 110 feeds paper currency bills until the pressure (which may, hereinafter, be referred to as "detected pressure") detected by the pressure sensor 130 becomes less than a predetermined set value (which may, hereinafter, be referred to as a "lower limit set value SV11"). The feeding process by the pickup roller 110 is started in a state where the detected pressure is equal to or greater than the lower limit set value SV11. The detected pressure is reduced every time one paper currency bill is fed by the pickup roller 110, and the feeding process is executed by the pickup roller 110 until the detected pressure becomes less than the lower limit set value SV11. Hereinafter, the number of paper currency bills fed in each feeding process may be referred to as the number of fed sheets.

Further, the stage 120 presses the paper currency bills that are accumulated until the detected pressure reaches another set value (which may, hereinafter, be referred to as a "proper set value SV12") against the pickup roller 110 for each feeding process by the pickup roller 110. For example, the paper sheet handling apparatus 1 starts a feeding process from a state where the detected pressure is at the proper set value SV12. When the detected pressure becomes less than the lower limit set value SV11, the paper sheet handling apparatus 1 ends the feeding process by the pickup roller 110 and moves the stage 120 towards the pickup roller 110 until the detected pressure reaches the proper set value SV12. That is, the paper sheet handling apparatus 1 lifts up the stage 120.

The proper set value SV12 may be set as appropriate, as long as the proper set value SV12 is equal to or greater than the lower limit set value SV11. For example, the proper set value SV12 may be set based on performance or the like of the pickup roller 110.

Further, for the pickup roller 110, based on the amount of movement of the stage 120 measured by the measuring unit of the driving mechanism 140 after the feeding process and the number of fed sheets, a calculated feeding value is calculated. If the calculated feeding value is less than a predetermined threshold (which may, hereinafter, be referred to as a "feeding threshold TH11") for calculated feeding value, operation is executed at the feeding speed of a first speed. Furthermore, if the calculated feeding value is equal to or greater than the feeding threshold TH11, operation is executed at the feeding speed of a second speed that is slower than the first speed. That is, the pickup roller 110 executes feeding of paper currency bills at a high speed when the calculated feeding value is less than the feeding threshold TH11, and executes feeding of paper currency bills at a low speed when the calculated feeding value is equal to or greater than the feeding threshold TH11. This point will be described based on the drawings. The first speed and the second speed may be set as appropriate according to purposes, as long as the first speed is faster than the second speed, and for example, may be set based on performance or the like of the paper sheet handling apparatus 1.

Figure 1:
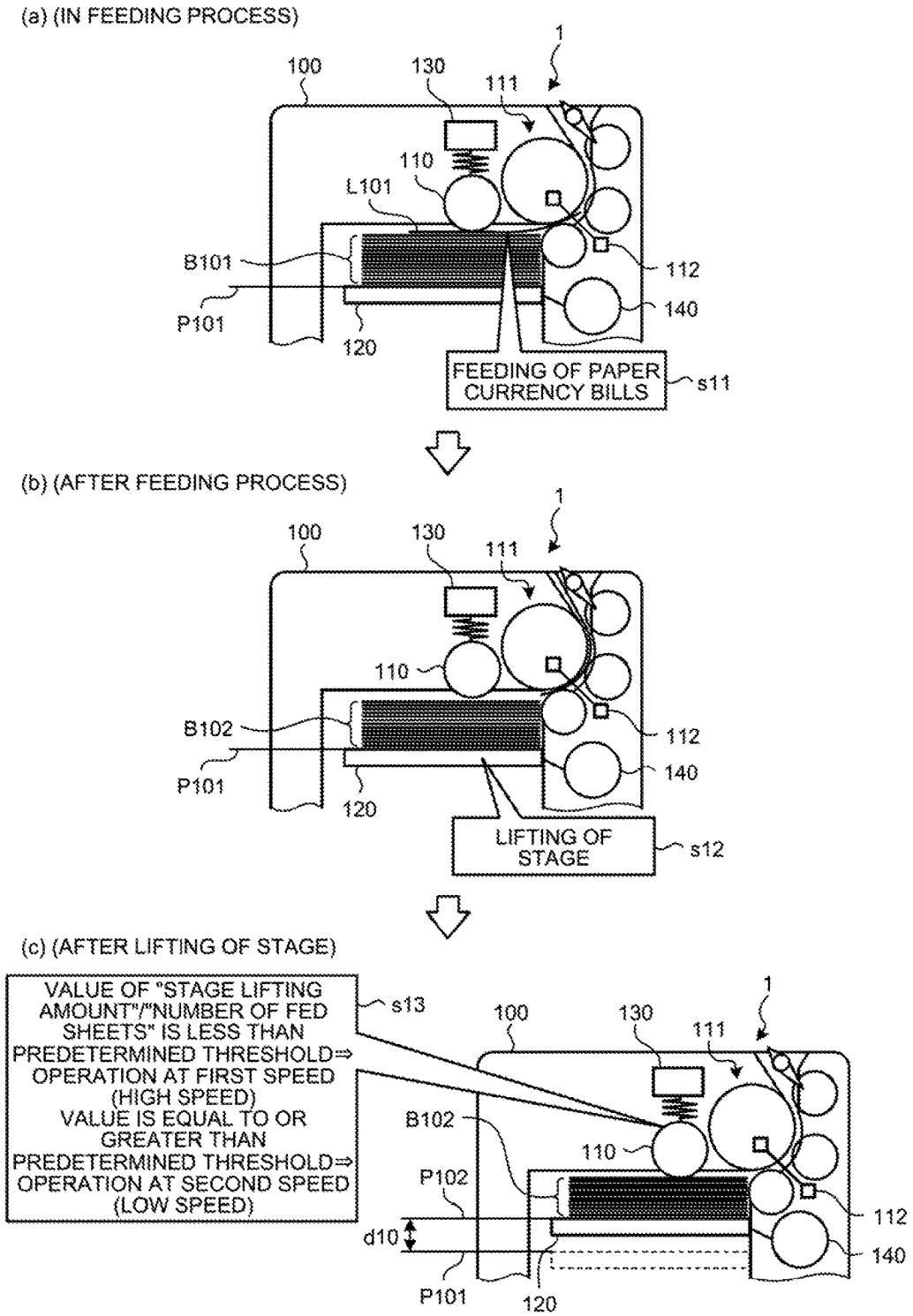
FIG. 1 is a diagram illustrating an outline of a process, in which feeding speed is changed, according to a first embodiment.

FIG. 1 is a diagram illustrating an outline of a process, in which the feeding speed is changed, according to the first embodiment. Before start of a feeding process, the stage 120 lifts up paper currency bills, which have been accumulated until the detected pressure reaches the proper set value SV12, to a position where the paper currency bills are pressed against the pickup roller 110. For example, after a feeding process and before start of the next feeding process, the stage 120 lifts up paper currency bills, which have been accumulated until the detected pressure reaches the proper set value SV12, to a position where the paper currency bills are pressed against the pickup roller 110.

In the example illustrated in FIG. 1, a position P101 indicates a position of an end surface (hereinafter, referred to as an "upper end surface") of the stage 120, the end surface facing the pickup roller 110 at the start of the feeding process. For example, in the cassette 100 upon the feeding process illustrated in FIG. 1(*a*), a paper currency bill bundle B101 has been accumulated on the stage 120. Paper currency bills L101 are then fed one by one by the pickup roller 110 (Step s11). Upon this feeding, the number of paper currency bills L101 fed is counted by the optical sensor 112.

Every time the pickup roller 110 feeds one of the paper currency bills L101, the whole height of the paper currency bill bundle B101 is decreased by the thickness of the fed paper currency bill L101. That is, the pressing pressure of the stage 120 against the pickup roller 110 is decreased every time one of the paper currency bills L101 is fed. Therefore, as the paper currency bills L101 are fed by the feeding process of the pickup roller 110 one by one, the detected pressure gradually decreases from the proper set value SV12, until the detected pressure becomes less than the lower limit set value SV11. The paper sheet handling apparatus 1 ends the feeding process when the detected pressure becomes less than the lower limit set value SV11.

In the cassette 100 after the feeding process illustrated in FIG. 1(*b*), the feeding process has ended by the detected pressure having become less than the lower limit set value SV11. At this time, a paper currency bill bundle B102 is accumulated on the stage 120. For example, the paper currency bill bundle B102 represents a paper currency bill bundle in a state where paper currency bills worth the number of fed sheets have been fed from the paper currency bill bundle B101. Before starting the next feeding process, the paper sheet handling apparatus 1 lifts up the stage 120 until the detected pressure reaches the proper set value SV12 (Step s12). Upon this lifting, the measuring unit of the driving mechanism 140 measures the amount of movement (lifting amount) of the stage 120 by, for example, conversion from the number of steps input to the stepping motor.

In the cassette 100 after the lifting of the stage illustrated in FIG. 1(*c*), the detected pressure reaches the proper set value SV12. The height of the paper currency bill bundle B102 on the stage 120 in the state where the detected pressure has reached the proper set value SV12 is equal to or lower than the height of the paper currency bill bundle B102 before the lifting of the stage. A position P102 indicates a position of the upper end surface of the stage 120 in the state where the detected pressure has reached the proper set value SV12. That is, after the feeding process is executed and before the next feeding process is started, the stage 120 is lifted up towards the pickup roller 110 by a positional difference in the up-down direction between the position P102 and the position P101. A stage lifting amount d10 illustrated in FIG. 1 (="position P102"−"position P101") represents a lifting amount, by which the stage 120 has been lifted up from the position P101 to the position P102. That is, the measuring unit of the driving mechanism 140 measures the stage lifting amount d10 illustrated in FIG. 1 by, for example, conversion from the number of steps input to the stepping motor.

Thereafter, the paper sheet handling apparatus 1 determines, based on the number of fed sheets obtained in the feeding process executed above and the stage lifting amount, the feeding speed of the pickup roller 110 in the next feeding process (Step s13). For example, the paper sheet handling apparatus 1 sets the feeding speed of the pickup roller 110 to the first speed, if the calculated feeding value, which is a value calculated by the following Equation (1), is less than the predetermined threshold for calculated feeding value.

$$\text{Calculated feeding value} = \text{Stage lifting amount}/\text{Number of fed sheets} \quad (1)$$

Further, the paper sheet handling apparatus 1 sets the feeding speed of the pickup roller 110 to the second speed, if the calculated feeding value calculated by the above Equation (1) is equal to or greater than the predetermined threshold for calculated feeding value. Specifically, the paper sheet handling apparatus 1 sets the feeding speed of the pickup roller 110 to the first speed if the calculated feeding value is less than the feeding threshold TH11. That is, if the calculated feeding value is less than the feeding threshold TH11, the paper sheet handling apparatus 1 causes the pickup roller 110 to operate at a high speed. Further, the paper sheet handling apparatus 1 sets the feeding speed of the pickup roller 110 to the second speed if the calculated feeding value is equal to or greater than the feeding threshold TH11. That is, if the calculated feeding value is equal to or greater than the feeding threshold TH11, the paper sheet handling apparatus 1 causes the pickup roller 110 to operate at a low speed. Thereby, since the paper sheet handling apparatus 1 is able to set the feeding speed according to the state of the paper currency bills, the possibility of occurrence of damage to the paper currency bills or a conveyance jam is able to be decreased and the conveyance speed of the paper currency bills is able to be increased.

[Paper Currency Bill Feeding Process by Paper Sheet Handling Apparatus]

Figure 5:
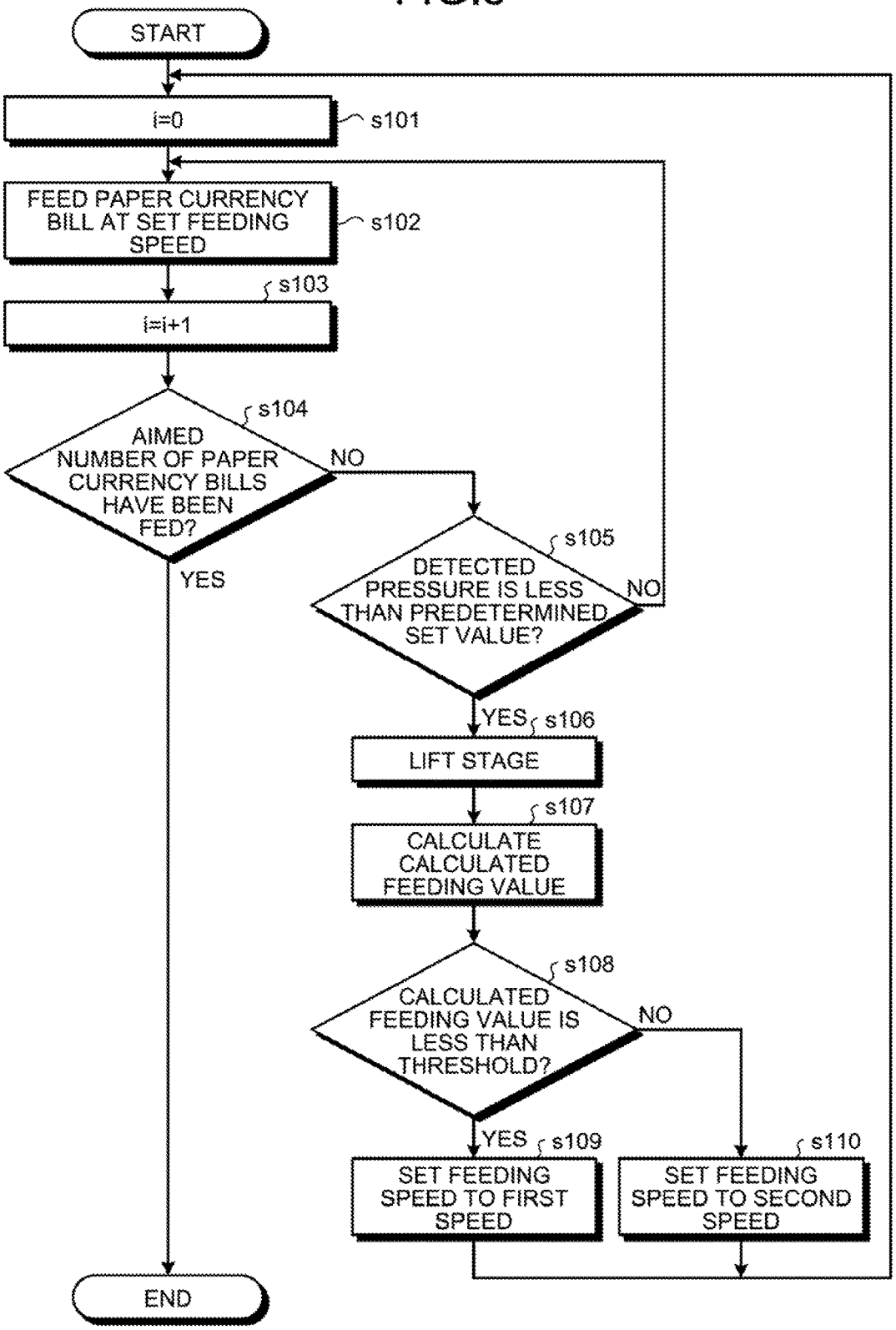
FIG. 5 is a flow chart of a process by the paper sheet handling apparatus according to the first embodiment.

Next, by use of FIG. 5, a process, in which the paper sheet handling apparatus 1 according to the first embodiment feeds paper currency bills while changing the feeding speed, will be described. FIG. 5 is a flow chart of a process by the paper sheet handling apparatus according to the first embodiment. For example, the paper sheet handling apparatus 1 executes the following process when withdrawal of money is instructed.

As illustrated in FIG. 5, the paper sheet handling apparatus 1 sets a variable, "i", which is a count of the number of fed sheets in each feeding process, to "0" (Step s101). When the first feeding process is started, the paper sheet handling apparatus 1 starts the feeding process from, for example, a state where the detected pressure has reached the proper set value SV12.

Subsequently, the paper sheet handling apparatus 1 feeds a paper currency bill at a set feeding speed (Step s102). Specifically, the paper sheet handling apparatus 1 feeds one paper currency bill by causing the pickup roller 110 to operate at the set feeding speed. When the paper sheet handling apparatus 1 starts the first feeding process, for example, an initial speed that is set between the first speed and the second speed may be set as the feeding speed. The paper sheet handling apparatus 1 may set the first speed or the second speed as the feeding speed when the first feeding process is started. The paper sheet handling apparatus 1 increments the variable, "i", by "1" every time a paper currency bill is fed (Step s103). For example, the paper sheet handling apparatus 1 increments the variable, "i", by "1", when the light output by the optical sensor 112 is intercepted. Thereby, the paper sheet handling apparatus 1 counts the number of fed sheets for each feeding process.

The paper sheet handling apparatus 1 then ends the process of feeding paper currency bills when the aimed number of paper currency bills have been fed (Step s104; Yes). The aimed number referred to herein refers to, for example, the number of paper currency bills that have been instructed to be withdrawn at the ATM.

Further, if the aimed number of paper currency bills have not been fed (Step s104; No), the paper sheet handling apparatus 1 checks whether the detected pressure is less than the predetermined set value (Step s105). For example, the paper sheet handling apparatus 1 checks whether the detected pressure is less than the lower limit set value SV11. If the detected pressure is not less than the predetermined set value, that is, if the detected pressure is equal to or greater than the predetermined set value (Step s105; No), the paper sheet handling apparatus 1 returns to Step s102 and executes processing. Further, if the detected pressure has become less than the predetermined set value (Step s105; Yes), the paper sheet handling apparatus 1 ends the feeding process, and lifts up the stage 120 and sets the feeding speed in order to execute the next feeding process.

Further, if the detected pressure has become less than the predetermined set value (Step s105; Yes), the paper sheet handling apparatus 1 lifts up the stage 120 until the detected pressure reaches another set value (Step s106). For example, if the detected pressure has become less than the lower limit set value SV11, the paper sheet handling apparatus 1 lifts up the stage 120 until the detected pressure reaches the proper set value SV12. The paper sheet handling apparatus 1 then calculates, based on the number of fed sheets, "i", counted in Step s103 and the lifting amount of the stage 120 in Step s106, a calculated feeding value (Step s107). For example, the paper sheet handling apparatus 1 calculates the calculated feeding value by using the above Equation (1).

Subsequently, if the calculated feeding value calculated in Step s107 is less than a threshold (Step s108; Yes), the paper sheet handling apparatus 1 sets the feeding speed to the first speed (Step s109). For example, in a case where the calculated feeding value calculated in Step s107 is less than the feeding threshold TH11, the paper sheet handling apparatus 1 changes the feeding speed to the first speed if the feeding speed has been set to a speed other than the first speed. Further, if the calculated feeding value calculated in Step s107 is equal to or greater than the threshold (Step s108; No), the paper sheet handling apparatus 1 sets the feeding speed to the second speed (Step s110). For example, in a case where the calculated feeding value calculated in Step s107 is equal to or greater than the feeding threshold TH11, the paper sheet handling apparatus 1 changes the feeding speed to the second speed if the feeding speed has been set to a speed other than the second speed. Thereafter, the paper sheet handling apparatus 1 repeats the process from Step s101 after setting the feeding speed in Step s109 or Step s110.

If an average value of the calculated feeding values of the respective plural feeding processes is less than the feeding threshold TH11, the paper sheet handling apparatus 1 operates at the feeding speed of the first speed. Further, if the average value of the calculated feeding values of the respective plural feeding processes is equal to or greater than the feeding threshold TH11, the operation may be executed at the feeding speed of the second speed. For example, the paper sheet handling apparatus 1 may set the feeding speed to the first speed if the average value of the calculated feeding values of the latest five feeding processes is less than the feeding threshold TH11. Furthermore, for example, the paper sheet handling apparatus 1 may set the feeding speed to the second speed if the average value of the calculated feeding values of the latest five feeding processes is equal to or greater than the feeding threshold TH11. Thereby, since the paper sheet handling apparatus 1 is able to set the feeding speed more appropriately reflecting the state of the paper currency bills, the possibility of occurrence of damage to the paper currency bills or a conveyance jam is able to be decreased and the conveyance speed of the paper currency bills is able to be increased. Further, not being limited to the average value of the calculated feeding values of plural feeding processes, the paper sheet handling apparatus 1 may assign a weight value to each feeding process. Thereafter, if an average value of values obtained by multiplying the weight values and the calculated feeding values is less than a predetermined threshold, the operation is executed at the feeding speed of the first speed. Further, if the average value is equal to or greater than the predetermined threshold, the operation may be executed at the feeding speed of the second speed. In this case, the more recent the feeding process is, the greater the weight value may be made by the paper sheet handling apparatus 1.

[Effects]

The paper sheet handling apparatus 1 according to the first embodiment has the feeding unit (the pickup roller 110 in the first embodiment), the placement unit (the stage 120 in the first embodiment), the detection unit (the pressure sensor 130 in the first embodiment), and the measuring unit. The pickup roller 110 feeds paper sheets (paper currency bills in the first embodiment) by rotating. Paper currency bills are layered over one another and accumulated on the stage 120 in the thickness direction, and the stage 120 presses the paper currency bills against the pickup roller 110 by moving in the layering direction of the paper currency bills. The pressure sensor 130 detects the pressure applied on the pickup roller 110 due to the movement of the stage 120. The measuring unit measures the amount of movement of the stage 120. Further, for each feeding process, in which paper currency bills are fed by the pickup roller 110 until the pressure detected by the pressure sensor 130 becomes less than the predetermined set value (the lower limit set value SV11 in the first embodiment), the stage 120 presses the paper currency bills against the pickup roller 110 until the pressure detected by the pressure sensor 130 reaches another set value. Furthermore, for the pickup roller 110, the calculated feeding value is calculated based on the amount of movement of the stage 120 measured by the measuring unit after the feeding process and the number of fed sheets, which is the number of paper currency bills that have been fed by the feeding process. If the calculated feeding value is less than the predetermined threshold (the feeding threshold TH11 in the first embodiment), the operation is executed at the feeding speed of the first speed. Moreover, when the calculated feeding value is equal to or greater than the feeding threshold TH11, the operation is executed at the feeding speed of the second speed that is slower than the first speed. Thereby, the paper sheet handling apparatus 1 is able to set the feeding speed according to the state of the paper currency bills. Therefore, the paper sheet handling apparatus 1 enables the possibility of occurrence of damage to the paper currency bills or a conveyance jam to be decreased and the conveyance speed of the paper currency bills to be increased.

Further, in the paper sheet handling apparatus 1, the pickup roller 110 operates at the feeding speed of the first speed if an average value of calculated feeding values of plural feeding processes is less than the feeding threshold TH11, and operates at the feeding speed of the second speed if the average value is equal to or greater than the feeding threshold TH11. Thereby, the paper sheet handling apparatus 1 is able to set the feeding speed more appropriately reflecting the state of the paper currency bills. Therefore, the paper sheet handling apparatus 1 enables the possibility of occurrence of damage to the paper currency bills or a conveyance jam to be decreased and the conveyance speed of the paper currency bills to be increased.

Second Embodiment

Next, a paper sheet handling apparatus 2 according to a second embodiment of the present invention will be described, based on the drawings. In the paper sheet handling apparatus 2, the feeding speed is set based on the lifting amount of the stage 120 before the paper sheet handling apparatus 2 starts the process of feeding paper currency bills. The same signs will be appended to portions that are the same as those of the first embodiment, and description thereof will be omitted. In the paper sheet handling apparatus 2, the number of paper currency bills stored in each cassette 100A, that is, the number of paper currency bills accumulated on the stage 120 (which may, hereinafter, be referred to as "the number of accumulated paper currency bills") is counted by a suitable means. For example, the paper sheet handling apparatus 2 may count the number of paper currency bills stored in each cassette 100A by use of a configuration similar to that of the optical sensor 112 that counts the number of fed paper currency bills.

Figure 6:
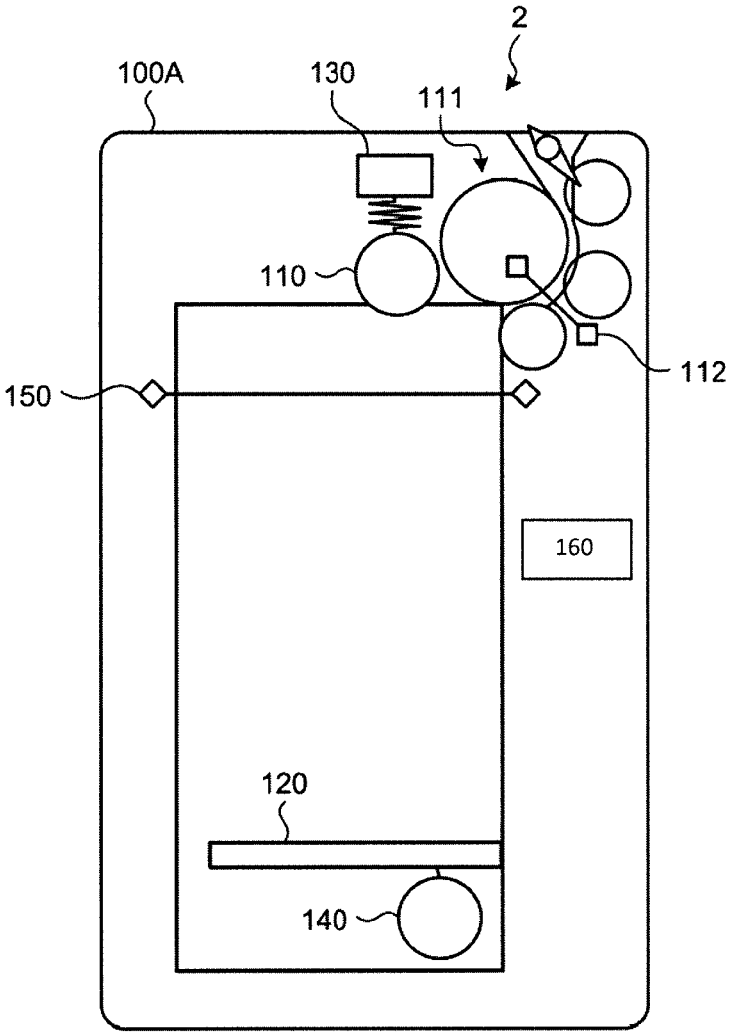
FIG. 6 is a diagram illustrating an example of an outline of a cassette according to a second embodiment.

Firstly, the cassette 100A is different from the cassette 100 according to the first embodiment in that the cassette 100A has a detecting unit provided therein. In an example illustrated in FIG. 6, the detecting unit is an optical sensor 150 (hereinafter, referred to as a "position sensor 150"), which is installed between the pickup roller 110 and the stage 120 in the moving direction of the stage 120 and detects passage of the paper currency bills layered over one another on the stage 120. For example, the position sensor 150 detects that an upper end of the paper currency bills layered over one another on the stage 120 has passed, by light output by the position sensor 150 being intercepted.

Further, the measuring unit 160 of the driving mechanism 140 measures, for example, a stage lifting amount (which may, hereinafter, be referred to as the "last lifting amount") of the stage 120 from when the passage of the upper end of the paper currency bills layered over one another on the stage 120 is detected by the position sensor 150 to when the detected pressure reaches the proper set value SV12.

If the number of paper currency bills accumulated on the stage 120 is the same, the larger the number of largely damaged paper currency bills is, the larger the amount, over which the paper currency bills are squashed by the pickup roller 110 until the detected pressure reaches the proper set value SV12, becomes. In other words, if the number of paper currency bills accumulated on the stage 120 is the same, the larger the number of largely damaged paper currency bills is, the larger the last lifting amount becomes.

For the pickup roller 110, the feeding speed is set according to a calculated accumulation value, which is calculated based on: the last lifting amount measured by the measuring unit 160 of the driving mechanism 140; and the number of paper sheets layered over one another on the stage 120. For example, the pickup roller 110 operates at the feeding speed of a first speed if the calculated accumulation value is less than the last predetermined threshold (which may, hereinafter, be referred to as the "last threshold TH12") for calculated accumulation value, and operates at the feeding speed of a second speed that is slower than the first speed if the calculated accumulation value is equal to or greater than the last threshold TH12. That is, the pickup roller 110 executes feeding of paper currency bills at a high speed when the calculated accumulation value is less than the last threshold TH12. Further, if the calculated accumulation value is equal to or greater than the last threshold TH12, feeding of paper currency bills is executed at a low speed. This point will be described based on the drawings. As long as the first speed is faster than the second speed, the first speed and the second speed may be the same as the first speed and the second speed of the first embodiment or may be different therefrom.

Figure 7:
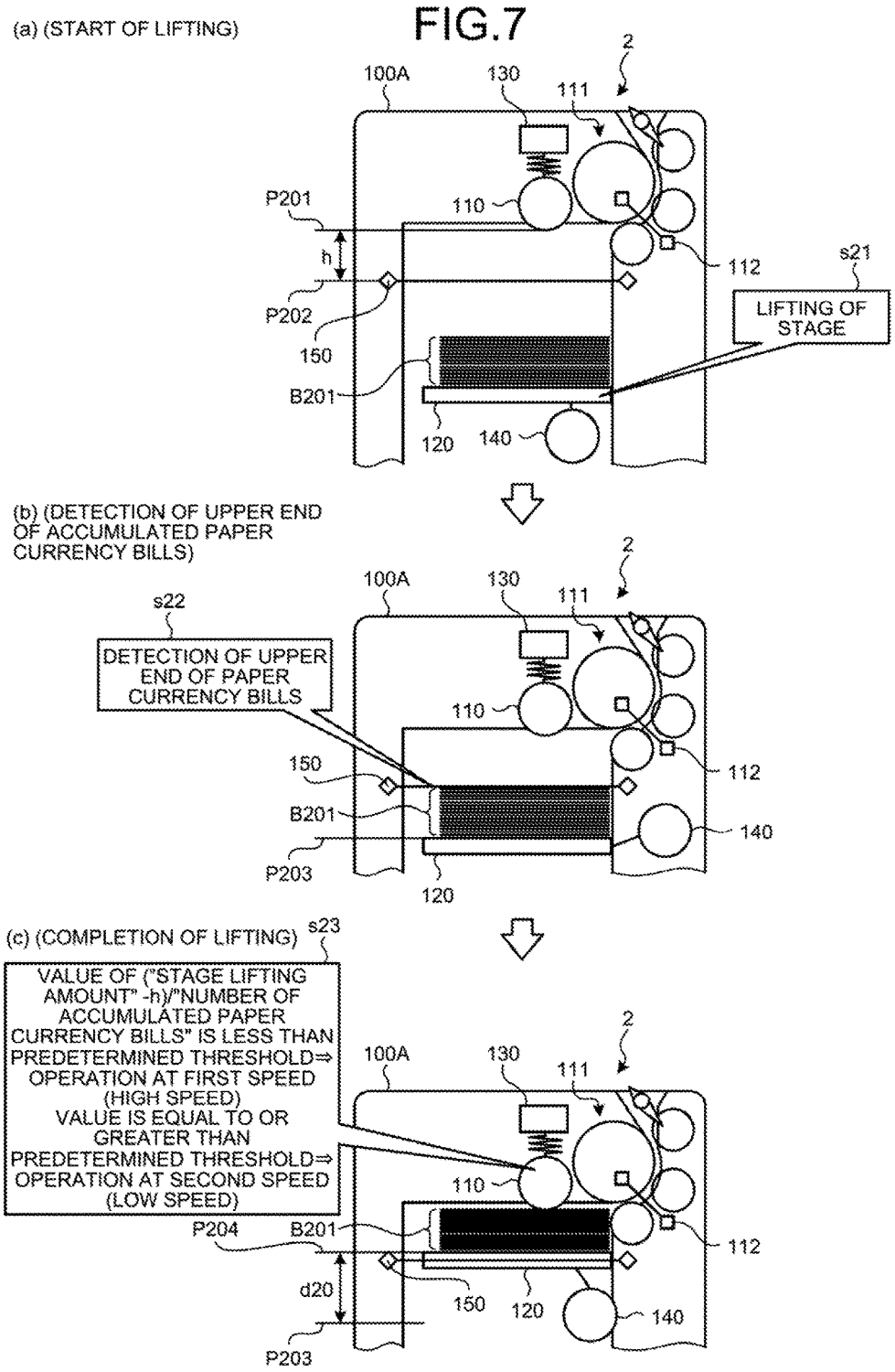
FIG. 7 is a diagram illustrating an outline of a process, in which feeding speed is changed, according to a second embodiment.

FIG. 7 is a diagram illustrating an outline of a process, in which the feeding speed is changed, according to the second embodiment. In the example illustrated in FIG. 7, a position P201 indicates a position of a lower end of the pickup roller 110. Further, a position P202 indicates a position where the position sensor 150 is installed. A positional difference in the up-down direction between the position P201 and the position P202, that is, a height, "h" (="position P201"–"position P202"), from the position sensor 150 to the lower end of the pickup roller 110, is obtained. For example, in the cassette 100A in a feeding process illustrated in FIG. 7(*a*), a paper currency bill bundle B201 has been accumulated on the stage 120, and the stage 120 starts being lifted up (Step s21).

In the cassette 100A after the feeding process illustrated in FIG. 7(*b*), passage of an upper end of the paper currency bill bundle B201 on the stage 120 is detected by the position sensor 150 upon the lifting of the stage 120 (Step s22). In the example illustrated in FIG. 7, a position P203 is where the passage of the upper end of the paper currency bill bundle B201 on the stage 120 is detected by the position sensor 150. The position P203 indicates a position of the upper end surface of the stage 120 upon this detection. For example, after the passage of the upper end of the paper currency bill bundle B201 on the stage 120 is detected by the position sensor 150, the measuring unit of the driving mechanism 140 starts measuring the lifting amount of a stage 102.

In the cassette 100A after completion of the lifting of the stage illustrated in FIG. 7(*c*), the detected pressure reaches the proper set value SV12. The height of the paper currency bill bundle B201 on the stage 120 in the state where the detected pressure has reached the proper set value SV12 is equal to or less than the height of the paper currency bill bundle 201 before the lifting of the stage, according to how much the paper currency bill bundle B201 is damaged. A position P204 indicates a position of the upper end surface of the stage 120 in the state where the detected pressure has reached the proper set value SV12. That is, from when the passage of the upper end of the paper currency bills layered over one another on the stage 120 is detected by the position sensor 150 to when the detected pressure reaches the proper set value SV12, the stage 120 is lifted towards the pickup roller 110 by the positional difference in the up-down direction between the position P204 and the position P203. A stage lifting amount d20 illustrated in FIG. 7 (="position P204"–"position P203") indicates a lifting amount, by which the stage 120 has been lifted up from the position P203 to the position P204, that is, the last lifting amount. For example, the measuring unit of the driving mechanism 140 measures the stage lifting amount d20, which is illustrated in FIG. 7 and is the last lifting amount, by, for example, conversion from the number of steps input to the stepping motor.

Thereafter, the paper sheet handling apparatus 2 determines, based on the number of accumulated paper currency bills and the last lifting amount (the stage lifting amount), the feeding speed of the pickup roller 110 in a process of feeding paper currency bills (Step s23). For example, the paper sheet handling apparatus 2 sets the feeding speed of the pickup roller 110 to the first speed, if the calculated accumulation value, which is a value calculated by the following Equation (2), is less than a predetermined threshold.

$$\text{"Calculated accumulation value"} = (\text{"Stage lifting amount"} - h)/\text{"Number of accumulated paper currency bills"} \quad (2)$$

Further, the paper sheet handling apparatus 2 sets the feeding speed of the pickup roller 110 to the second speed, if the calculated accumulation value calculated by the above Equation (2) is equal to or greater than the predetermined threshold for calculated accumulation value. Specifically, the paper sheet handling apparatus 2 sets the feeding speed of the pickup roller 110 to the first speed if the calculated accumulation value is less than the last threshold TH12. That is, if the calculated accumulation value is less than the last threshold TH21, the paper sheet handling apparatus 2 causes the pickup roller 110 to operate at a high speed. Further, the paper sheet handling apparatus 2 sets the feeding speed of the pickup roller 110 to the second speed if the calculated accumulation value is equal to or greater than the last threshold TH12. That is, if the calculated accumulation value is equal to or greater than the last threshold TH12, the paper sheet handling apparatus 2 causes the pickup roller 110 to operate at a low speed. Thereby, since the paper sheet handling apparatus 2 is able to set the feeding speed according to the state of the paper currency bills, the possibility of occurrence of damage to the paper currency bills or a conveyance jam is able to be decreased and the conveyance speed of the paper currency bills is able to be increased.

[Paper Currency Bill Feeding Process by Paper Sheet Handling Apparatus]

Figure 8:
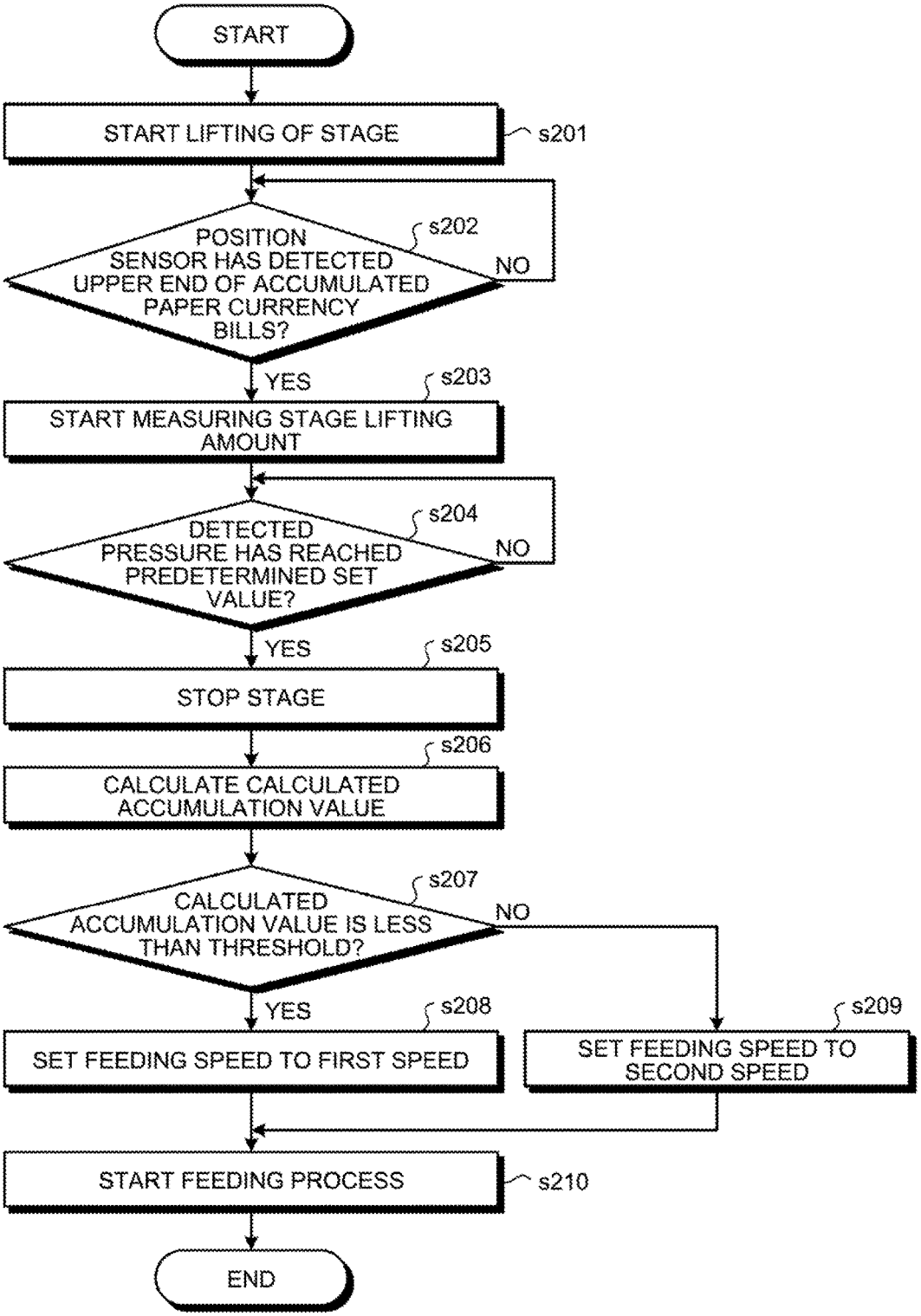
FIG. 8 is a flow chart of a process by a paper sheet handling apparatus according to the second embodiment.

Next, by use of FIG. 8, a process, in which the paper sheet handling apparatus 2 according to the second embodiment sets the feeding speed and feeds paper currency bills, will be described. FIG. 8 is a flow chart of a process by the paper sheet handling apparatus according to the second embodiment. For example, the paper sheet handling apparatus 2 executes the following process when withdrawal of money is instructed.

As illustrated in FIG. 8, the paper sheet handling apparatus 2 starts lifting the stage 120 (Step s201). Until an upper end of accumulated paper currency bills is detected by the position sensor 150 (Step s202; No), the paper sheet handling apparatus 2 repeats the detection for the upper end of the accumulated paper currency bills with the position sensor 150. For example, until the paper sheet handling apparatus 2 confirms that the upper end of the accumulated paper currency bills has been detected by the position sensor 150, the paper sheet handling apparatus 2 repeats the confirmation of whether the upper end of the accumulated paper currency bills has been detected by the position sensor 150. Further, if the position sensor 150 has detected the upper end of the accumulated paper currency bills (Step s202; Yes), the paper sheet handling apparatus 2 starts measuring a stage lifting amount (Step s203).

Thereafter, until the detected pressure by the pressure sensor 130 reaches the predetermined set value (Step s204; No), the paper sheet handling apparatus 2 repeats checking whether the detected pressure by the pressure sensor 130 has reached the predetermined set value. For example, until the detected pressure reaches the proper set value SV12, the paper sheet handling apparatus 2 checks whether the detected pressure has reached the proper set value SV12.

If the pressure detected by the pressure sensor 130 has reached the predetermined set value (Step s204; Yes), the paper sheet handling apparatus 2 stops lifting the stage 120 (Step s205). The paper sheet handling apparatus 2 calculates a calculated accumulation value based on: the stage lifting amount from when the upper end of the accumulated paper currency bills is detected by the position sensor 150 in Step s202 to when lifting of the stage 120 is stopped in Step s205; and the number accumulated paper currency bills (Step s206).

Subsequently, if the calculated accumulation value calculated in Step s206 is less than the threshold (Step s207; Yes), the paper sheet handling apparatus 2 sets the feeding speed to the first speed (Step s208). For example, if the calculated accumulation value calculated in Step s206 is less than the last threshold TH12, the paper sheet handling apparatus 2 sets the feeding speed to the first speed. Further, if the calculated accumulation value calculated in Step s206 is equal to or greater than the threshold (Step s207; No), the paper sheet handling apparatus 2 sets the feeding speed to the second speed (Step s209). For example, if the calculated accumulation value calculated in Step s206 is equal to or greater than the last threshold TH12, the paper sheet handling apparatus 2 sets the feeding speed to the second speed. Thereafter, the paper sheet handling apparatus 2 starts a feeding process (Step s210). For example, based on the feeding speed set in Step s208 or Step s209, the paper sheet handling apparatus 2 starts a process of feeding paper currency bills.

The paper sheet handling apparatus 2 may execute the process of feeding paper currency bills while changing the feeding speed illustrated in FIG. 5 of the first embodiment, in the feeding process started in Step s210. In this case, after starting the process of feeding paper currency bills based on the feeding speed set in Step s208 or Step s208, the paper sheet handling apparatus 2 executes the process of feeding paper currency bills while changing the feeding speed by the process of Steps s101 to s110 illustrated in FIG. 5. Thereby, since the paper sheet handling apparatus 2 sets the feeding speed according to the state of the paper currency bills and starts the process of feeding the paper currency bills, and feeds the paper currency bills while changing the feeding speed according to the state of the paper currency bills in the middle of the process, the possibility of occurrence of damage to the paper currency bills or a conveyance jam is able to be decreased even more and the conveyance speed of the paper currency bills is able to be increased.

[Effects]

The paper sheet handling apparatus 2 according to the second embodiment has the feeding unit (the pickup roller 110 in the second embodiment), the detection unit (the pressure sensor 130 in the second embodiment), the placement unit (the stage 120 in the second embodiment), the measuring unit, and the detecting unit (the position sensor 150 in the second embodiment). The pickup roller 110 feeds paper sheets (paper currency bills in the second embodiment) by rotating. The pressure sensor 130 detects pressure applied on the pickup roller 110. Paper currency bills are layered over one another and accumulated in the thickness direction on the stage 120, and the stage 120 presses the paper currency bills against the pickup roller 110 by moving in the layering direction of the paper currency bills until the pressure detected by the pressure sensor 130 reaches the predetermined set value (the proper set value SV12 in the second embodiment). The measuring unit measures the amount of movement of the stage 120. The position sensor 150 is installed between the pickup roller 110 and the stage 120 in the moving direction of the stage 120, and detects passage of the paper currency bills layered over one another on the stage 120. For the pickup roller 110, the calculated accumulation value is calculated based on: the amount of movement of the stage 120 measured by the measuring unit from when the passage of the paper currency bills is detected by the position sensor 150 to when the pressure detected by the pressure sensor 130 reaches the proper set value SV12; and the number of paper currency bills layered over one another on the stage 120. If the calculated accumulation value is less than the last predetermined threshold for calculated accumulation value (the last threshold TH12 in the embodiment), the operation is executed at the feeding speed of the first speed, and if the calculated accumulation value is equal to or greater than the last threshold TH12, the operation is executed at the second speed slower than the first speed. Thereby, since the paper sheet handling apparatus 2 is able to set the feeding speed according to the state of the paper currency bills, the possibility of occurrence of damage to the paper currency bills or a conveyance jam is able to be decreased and the conveyance speed of the paper currency bills is able to be increased.

In the paper sheet handling apparatus 2, for each feeding process, in which paper currency bills are fed by the pickup roller 110 until the pressure detected by the pressure sensor 130 becomes less than the predetermined set value (the lower limit set value SV11 in the second embodiment), the stage 120 presses the paper currency bills against the pickup roller 110 until the pressure detected by the pressure sensor 130 reaches another set value. Further, the pickup roller 110 operates at the feeding speed of the first speed if the calculated feeding value is less than the predetermined threshold for calculated feeding value (the feeding threshold TH11 in the second embodiment), and operates at the feeding speed of the second speed if the calculated feeding value is equal to or greater than the feeding threshold TH11, the calculated feeding value being calculated based on: the moving amount of the stage 120 measured by the measuring unit after the feeding process; and the number of fed sheets, which is the number of paper currency bills fed by the feeding process. Thereby, since the paper sheet handling apparatus 2 sets the feeding speed according to the state of paper currency bills and starts the process of feeding the paper currency bills, and feeds the paper currency bills while changing the feeding speed according to the state of the paper currency bills in the middle of the process, the possibility of occurrence of damage to the paper currency bills or a conveyance jam is able to be decreased even more and the conveyance speed of the paper currency bills is able to be increased.

Third Embodiment

Next, a paper sheet handling apparatus 3 according to a third embodiment of the present invention will be described, based on the drawings. In the paper sheet handling apparatus 3, the feeding speed is gradually set between a first speed and a second speed that is slower than the first speed. The same signs will be appended to portions that are the same as those of the first embodiment and second embodiment, and description thereof will be omitted. Further, the paper sheet handling apparatus 3 according to this embodiment has the same configuration as the paper sheet handling apparatus 2 according to the second embodiment illustrated in FIG. 7. Further, in the paper sheet handling apparatus 3, the number of paper currency bills stored in each cassette 100A, that is, the number of accumulated paper currency bills is counted by a suitable means. As long as the first speed is faster than the second speed, the first speed and the second speed may be the same as the first speed and the second speed of the first embodiment or may be different therefrom.

The paper sheet handling apparatus 3 updates the calculated accumulation value for each feeding process, and sets the feeding speed, based on the updated calculated accumulation value and the calculated feeding value of that feeding process. The paper sheet handling apparatus 3 uses the calculated accumulation value calculated by using the above Equation (2).

Since a calculated accumulation value, "D", which is a difference between a height of one sheet not being pressed and a height of the sheet being pressed, and a calculated feeding value, "d", which represents a thickness of one sheet, are both correlated with the extent of bending or crumpledness of the paper currency bill, approximation can be made as expressed by the following Equation (3) for the same paper currency bill in similar bent or crumpled states.

$$D \approx k \cdot d \tag{3}$$

For example, the value of a coefficient, "k", may be derived from experiments, and primary approximation may be made like in the above Equation (3), or polynomial approximation may be used. For example, the value of the coefficient, "k", may be derived by repetition of calculation of the calculated accumulation value, "D", by use of the above Equation (1), for accumulated paper currency bills, for which a certain calculated feeding value, "d", is obtained when a feeding process is executed at a certain calculated accumulation value D.

If the coefficient, "k", has been found, the calculated accumulation value for each feeding process is able to be updated by the following Equation (4).

$$D_{new} = (D_{old} \cdot (A+B) - k \cdot d \cdot B)/A \tag{4}$$

Herein, "$D_{new}$" is the calculated accumulation value that has been updated, and "$D_{old}$" is the calculated accumulation value before the feeding process. Further, "A" is the number of accumulated paper currency bills upon lifting of the stage, that is, the number of accumulated paper currency bills after the feeding process, and "B" is the number of fed sheets in the feeding process. That is, the sum of "A" and "B" is the number of accumulated paper currency bills before the feeding process.

Based on the calculated feeding value calculated for each feeding process with the above Equation (1), the paper sheet handling apparatus 3 increases or decreases the feeding speed, and changes the change in the feeding speed according to the calculated accumulation value at the start of the feeding process. This point will be described below.

In the process described below, a predetermined upper limit value (hereinafter, referred to as an "upper limit value TV11"), a predetermined lower limit value (hereinafter, referred to as a "lower limit value BV11"), and a predetermined threshold for calculated accumulation value (hereinafter, referred to as an "accumulation threshold TH13") are used. A magnitude correlation among the upper limit value TV11, the lower limit value BV11, and the accumulation threshold TH13 is defined as: "upper limit value TV11">"accumulation threshold TH13">"lower limit value BV11".

Firstly, if the calculated accumulation value amounts to the upper limit value TV11, the paper sheet handling apparatus 3 determines that the extent of bending or crumpledness in the accumulated paper currency bills remaining on the stage 120 is extremely large. In this case, even if the calculated feeding value is less than the feeding threshold TH11, the paper sheet handling apparatus 3 changes the feeding speed to a low speed. For example, if the calculated accumulation value amounts to the upper limit value TV11, regardless of the value of the calculated feeding value, the paper sheet handling apparatus 3 sets the feeding speed to the second speed. The case where the calculated accumulation value amounts to the upper limit value TV11 is an example, and the above control may be executed when, for example, the calculated accumulation value is close to the upper limit value TV11.

Subsequently, if the calculated accumulation value amounts to the lower limit value BV11, the paper sheet handling apparatus 3 determines that the extent of bending or crumpledness in the accumulated paper currency bills remaining on the stage 120 is small. In this case, even if the calculated feeding value is equal to or greater than the feeding threshold TH11, the paper sheet handling apparatus 3 changes the feeding speed to a high speed. For example, if the calculated accumulation value amounts to the lower limit value BV11, regardless of the value of the calculated feeding value, the paper sheet handling apparatus 3 sets the feeding speed to the first speed. The case where the calculated accumulation value amounts to the lower limit value BV11 is an example, and the above control may be executed when, for example, the calculated accumulation value is close to the lower limit value BV11.

Further, if the calculated accumulation value exceeds the accumulation threshold TH13, the paper sheet handling apparatus 3 determines that the extent of bending or crumpledness in the accumulated paper currency bills remaining on the stage 120 is large. In this case, even if the calculated feeding value is less than the feeding threshold TH11, the paper sheet handling apparatus 3 reduces the amount of increase in the feeding speed. For example, if the calculated feeding value is less than the feeding threshold TH11 and the calculated accumulation value exceeds the accumulation threshold TH13, the paper sheet handling apparatus 3 makes the amount of increase in the feeding speed smaller than that in the case where the calculated feeding value is less than the feeding threshold TH11 and the calculated accumulation value is equal to or less than the accumulation threshold TH13.

Further, if the calculated accumulation value is less than the accumulation threshold TH13, the paper sheet handling apparatus 3 determines that the extent of bending or crumpledness in the accumulated paper currency bills remaining on the stage 120 is small. In this case, the paper sheet handling apparatus 3 reduces the amount of decrease in the feeding speed if the calculated feeding value is equal to or greater than the feeding threshold TH11. For example, if the calculated feeding value is not less than the feeding threshold TH11 and the calculated accumulation value is less than the accumulation threshold TH13, the paper sheet handling apparatus 3 makes the amount of decrease in the feeding speed smaller than that in the case where the calculated feeding value is not less than the feeding threshold TH11 and the calculated accumulation value is equal to or greater than the accumulation threshold TH13.

As described above, by updating the calculated accumulation value for each feeding process, the paper sheet handling apparatus 3 is able to set the feeding speed, based on the calculated accumulation value reflecting appropriately the state of the accumulated paper currency bills on the stage 120.

[Paper Currency Bill Feeding Process by Paper Sheet Handling Apparatus]

Figure 9:
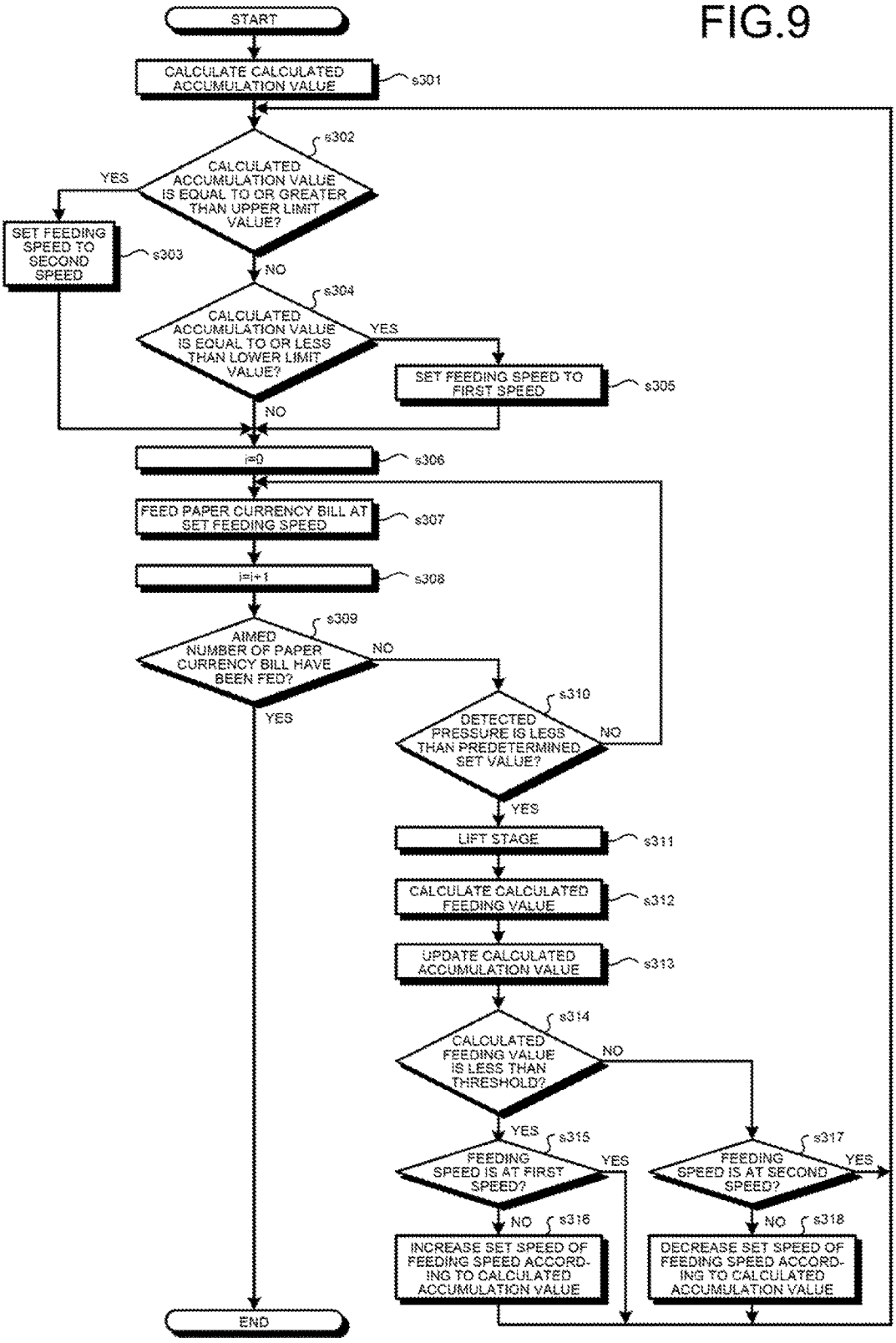
FIG. 9 is a flow chart of a process by a paper sheet handling apparatus according to a third embodiment.

Next, by use of FIG. 9, a process, in which the paper sheet handling apparatus 3 according to the third embodiment feeds paper currency bills while changing the feeding speed, will be described. FIG. 9 is a flow chart of the process by the paper sheet handling apparatus according to the third embodiment. For example, the paper sheet handling apparatus 3 executes the following process when withdrawal of money is instructed. Before the following process is started, the paper sheet handling apparatus 3 may set, as the feeding speed, for example, an initial speed that is set between the first speed and the second speed.

As illustrated in FIG. 9, the paper sheet handling apparatus 3 calculates a calculated accumulation value (Step s301). For example, the paper sheet handling apparatus 3 calculates the calculated accumulation value by executing the processing from Step s201 to Step s206 illustrated in FIG. 8. For example, if withdrawal of money has been instructed, the paper sheet handling apparatus 3 starts lifting the stage 120, and keeps lifting the stage until the detected pressure reaches the proper set value SV12. The paper sheet handling apparatus 3 then calculates the calculated accumulation value by using the above Equation (2).

Subsequently, if the calculated accumulation value is equal to or greater than the predetermined upper limit value (Step s302; Yes), the paper sheet handling apparatus 3 sets the feeding speed to the second speed (Step s303). For example, if the calculated accumulation value is equal to or greater than the upper limit value TV11, the paper sheet handling apparatus 3 sets the feeding speed to the second speed. Thereafter, the paper sheet handling apparatus 3 starts the feeding process from s306 at the feeding speed that has been set to the second speed. If the calculated accumulation value is not equal to or greater than the predetermined upper limit value (Step s302; No), it is determined whether the calculated accumulation value is equal to or less than the predetermined lower limit value (Step s304).

If the calculated accumulation value is equal to or less than the predetermined lower limit value (Step s304; Yes), the paper sheet handling apparatus 3 set the feeding speed to the first speed (Step s305). For example, if the calculated accumulation value is equal to or less than the predetermined lower limit value BV11, the paper sheet handling apparatus 3 sets the feeding speed to the first speed. Thereafter, the paper sheet handling apparatus 3 starts the feeding process from s306 at the feeding speed that has been set to the first speed. If the calculated accumulation value is not equal to or less than the predetermined lower limit value (Step s304; No), the feeding process from s306 is started at the set feeding speed.

Thereafter, the paper sheet handling apparatus 3 sets the variable, "i", which is the count of the number of fed sheets in each feeding process, to "0" (Step s306). Subsequently, the paper sheet handling apparatus 3 feeds paper currency bills at the set feeding speed (Step s307). Specifically, the paper sheet handling apparatus 3 feeds one paper currency bill by causing the pickup roller 110 to operate at the set feeding speed. The paper sheet handling apparatus 3 increments the variable, "i", by "1", every time a paper currency bill is fed (Step s308). For example, the paper sheet handling apparatus 3 counts the number of fed sheets in each feeding process, by incrementing the variable, "i", by "1", when the light output by the optical sensor 112 is intercepted.

When the aimed number of paper currency bills has been fed (Step s309; Yes), the paper sheet handling apparatus 3 then ends the process of feeding paper currency bills. The aimed number referred to herein is, for example, the number of paper currency bills that has been instructed to be withdrawn at the ATM.

Further, if the aimed number of paper currency bills have not been fed (Step s309; No), the paper sheet handling apparatus 3 checks whether the detected pressure is less than a predetermined set value (Step s310). For example, the paper sheet handling apparatus 3 checks whether the detected pressure is less than the lower limit set value SV11. If the detected pressure is not less than the predetermined set value, that is, if the detected pressure is equal to or greater than the predetermined set value (Step s310; No), the paper sheet handling apparatus 3 returns to Step s307 and executes the feeding process. Further, if the detected pressure has become less than the predetermined set value (Step s310; Yes), the paper sheet handling apparatus 3 ends the feeding process, and lifts up the stage 120 and changes the feeding speed in order to execute the next feeding process.

If the detected pressure has become less than the predetermined set value (Step s310; Yes), the paper sheet handling apparatus 3 lifts up a stage 121 until the detected pressure reaches another set value (Step s311). For example, if the detected pressure has become less than the lower limit set value SV31, the paper sheet handling apparatus 3 lifts up the stage 120 until the detected pressure reaches the proper set value SV12. The paper sheet handling apparatus 3 then calculates, based on the number of fed sheets, "i", counted in Step s308 and the lifting amount of the stage 120 in Step s311, a calculated feeding value (Step s312). For example, the paper sheet handling apparatus 3 calculates the calculated feeding value by using the above Equation (1). Further, based on the calculated accumulation value upon the feeding process and the calculated feeding value calculated in Step s312, the paper sheet handling apparatus 3 updates the calculated accumulation value (Step s313). For example, the paper sheet handling apparatus 3 updates the calculated accumulation value by using the above Equation (4).

Subsequently, if the calculated feeding value calculated in Step s312 is less than a threshold (Step s314; Yes), the paper sheet handling apparatus 3 executes the processing of increasing the feeding speed. If the calculated feeding value calculated in Step s312 is less than the threshold (Step s314; Yes) and the feeding speed has not reached the first speed (Step s315; No), the set speed for the feeding speed is increased according to the calculated accumulation value (Step s316). For example, if the calculated accumulation value updated in Step s313 exceeds the accumulation threshold TH13, the paper sheet handling apparatus 3 determines that the extent of bending or crumpledness in the accumulated paper currency bills remaining on the stage 120 is large, and makes the amount of increase in the feeding speed smaller than that in the case where the calculated accumulation value is equal to or less than the accumulation threshold TH13. Thereafter, the paper sheet handling apparatus 3 returns to Step s302 and repeats the processing.

Further, if the calculated feeding value calculated in Step s312 is less than the threshold (Step s314; Yes) and the feeding speed is at the first speed (Step s315; Yes), without changing the feeding speed, the paper sheet handling apparatus 3 returns to Step s302 and repeats the processing.

Further, if the calculated feeding value calculated in Step s312 is equal to or greater than the threshold (Step s314; No), the paper sheet handling apparatus 3 executes the processing of decreasing the feeding speed. If the calculated feeding value calculated in Step s312 is not less than the threshold (Step s314; No) and the feeding speed has not reached the second speed (Step s317; No), the set speed for the feeding speed is decreased according to the calculated accumulation value (Step s318). For example, if the calculated accumulation value updated in Step s313 is less than the accumulation threshold TH13, the paper sheet handling apparatus 3 determines that the extent of bending or crumpledness in the accumulated paper currency bills remaining on the stage 120 is small, and makes the amount of decrease in the feeding speed smaller than that in the case where the calculated accumulation value is equal to or greater than the accumulation threshold TH13. Thereafter, the paper sheet handling apparatus 3 returns to Step s302 and repeats the processing.

Further, if the calculated feeding value calculated in Step s312 is equal to or greater than the threshold (Step s314; No) and the feeding speed is at the second speed (Step s317; Yes), without changing the feeding speed, the paper sheet handling apparatus 3 returns to Step s302 and repeats the processing.

Figure 10:
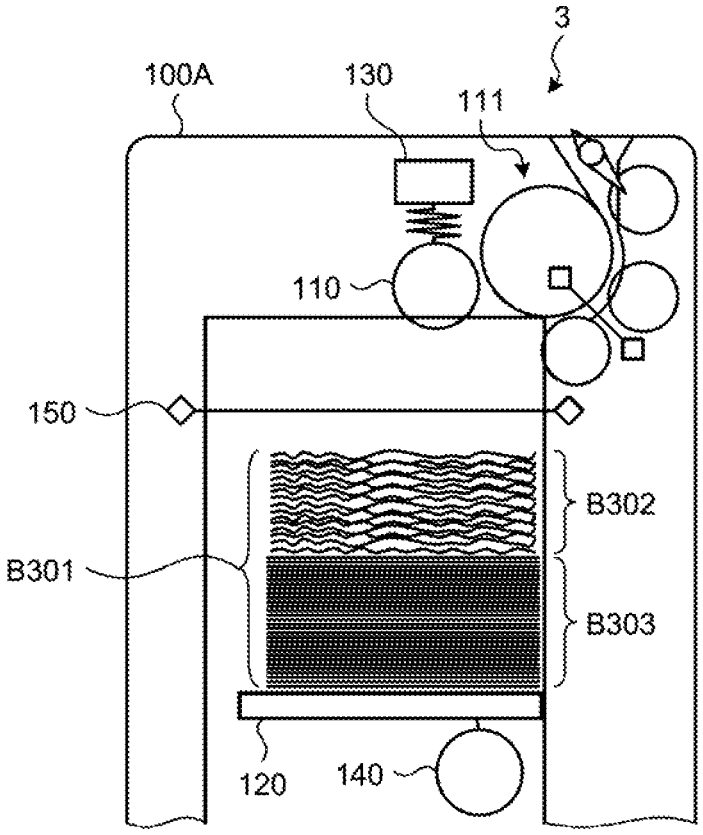
FIG. 10 is a diagram illustrating an example of paper currency bills accumulated in a cassette according to the third embodiment.
Figure 11:
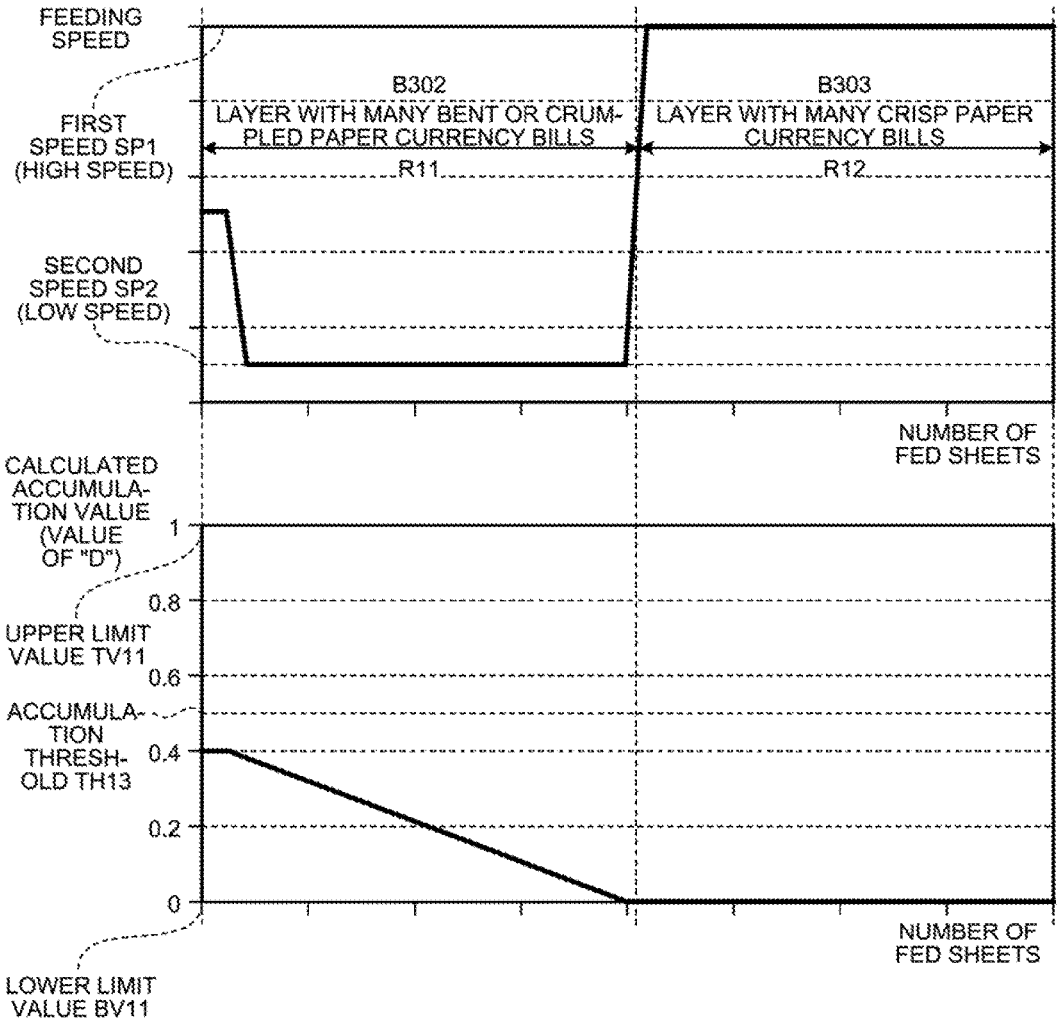
FIG. 11 is a diagram illustrating an example of a process, in which feeding speed is changed, according to the third embodiment.

Next, an example of a process based on the procedure illustrated in FIG. 9 will be described based on FIG. 10 to FIG. 13. FIG. 10 and FIG. 11 illustrate an example, in which largely damaged paper currency bills are accumulated at an upper portion of accumulated paper currency bills on the stage 120, and less damaged paper currency bills are accumulated at a lower portion thereof. FIG. 10 is a diagram illustrating an example of paper currency bills accumulated in the cassette according to the third embodiment. FIG. 11 is a diagram illustrating an example of a process, in which the feeding speed is changed, according to the third embodiment.

As illustrated in FIG. 10, a paper currency bill bundle B301 on the stage 120 represents a case where a paper currency bill bundle B302 including largely damaged paper currency bills is accumulated at an upper portion of the paper currency bill bundle B301, and a paper currency bill bundle B303 including less damaged paper currency bills is accumulated at a lower portion thereof. FIG. 11 illustrates change in the feeding speed and the calculated accumulation value, in a case where a process based on the procedure illustrated in FIG. 9 is executed when the largely damaged paper currency bills are accumulated at the upper portion of the accumulated paper currency bills and the less damaged paper currency bills are accumulated at the lower portion thereof as illustrated in FIG. 10. In the example illustrated in FIG. 10 and FIG. 11, the upper limit value TV11 is "1", the lower limit value BV11 is "0", and the accumulation threshold TH13 is "0.5". Further, with respect to the example illustrated in FIG. 10 and FIG. 11, the first speed will be described as a first speed SP1 and the second speed as a second speed SP2.

Firstly, in the example illustrated in FIG. 10 and FIG. 11, since the calculated accumulation value is "0.4", which is in a range between the upper limit value TV11 and the lower limit value BV11, the paper sheet handling apparatus 3 starts a feeding process with the feeding speed at a speed selected between the first speed SP1 and the second speed SP2. Thereafter, as illustrated in FIG. 11, since the paper sheet handling apparatus 3 feeds the paper currency bill bundle B302 including the largely damaged paper currency bills accumulated at the upper portion, the calculated feeding value becomes equal to or greater than the feeding threshold TH11. Therefore, the paper sheet handling apparatus 3 gradually decreases the feeding speed. When the feeding speed reaches the second speed SP2, the paper sheet handling apparatus 3 then executes the feeding process with the feeding speed set to the second speed SP2 if the calculated feeding value is equal to or greater than the feeding threshold TH11.

In the example illustrated in FIG. 11, an interval R11 represents an interval, in which the paper sheet handling apparatus 3 feeds the paper currency bill bundle B302 including the largely damaged paper currency bills. If most of the paper currency bill bundle B302 including the largely damaged paper currency bills has been fed, most of the paper currency bill bundle B301 on the stage 120 becomes the paper currency bill bundle B303 including the less damaged paper currency bills. The calculated accumulation value then reaches, for example, the lower limit value BV11. Therefore, the paper sheet handling apparatus 3 sets the feeding speed to the first speed SP1, and executes the feeding process at a high speed in an interval R12 representing an interval, in which the paper sheet handling apparatus 3 feeds the paper currency bill bundle B303 including the less damaged paper currency bills. Thereby, the paper sheet handling apparatus 3 avoids the risk of a jam by dropping the feeding speed in the layer of bent or crumpled paper currency bills, and immediately increases the feeding speed in the layer with many crisp paper currency bills. Therefore, the possibility of occurrence of damage to the paper currency bills or a conveyance jam is able to be decreased and the conveyance speed of the paper currency bills is able to be increased.

Figure 12:
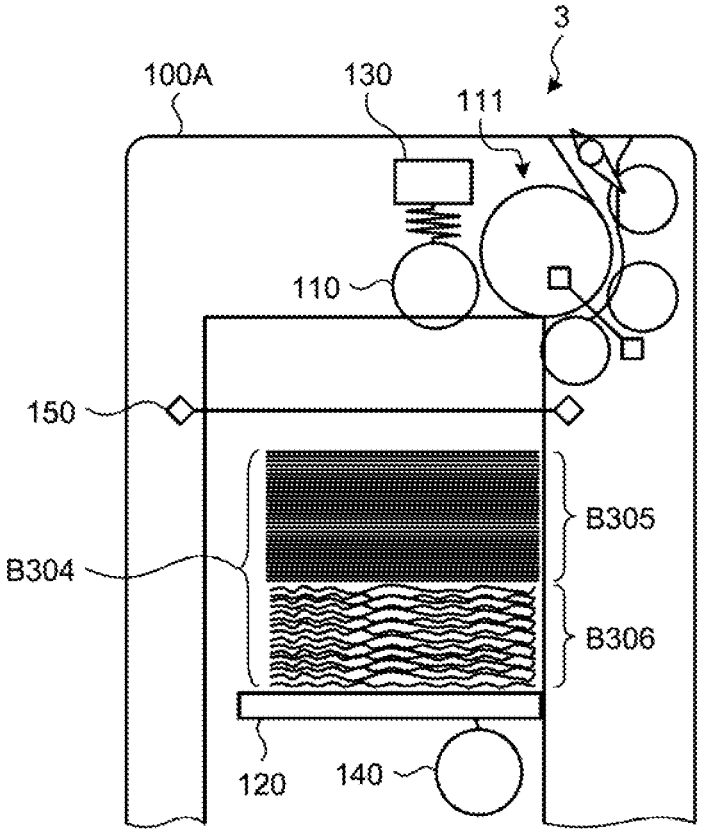
FIG. 12 is a diagram illustrating another example of the paper currency bills accumulated in the cassette according to the third embodiment.
Figure 13:
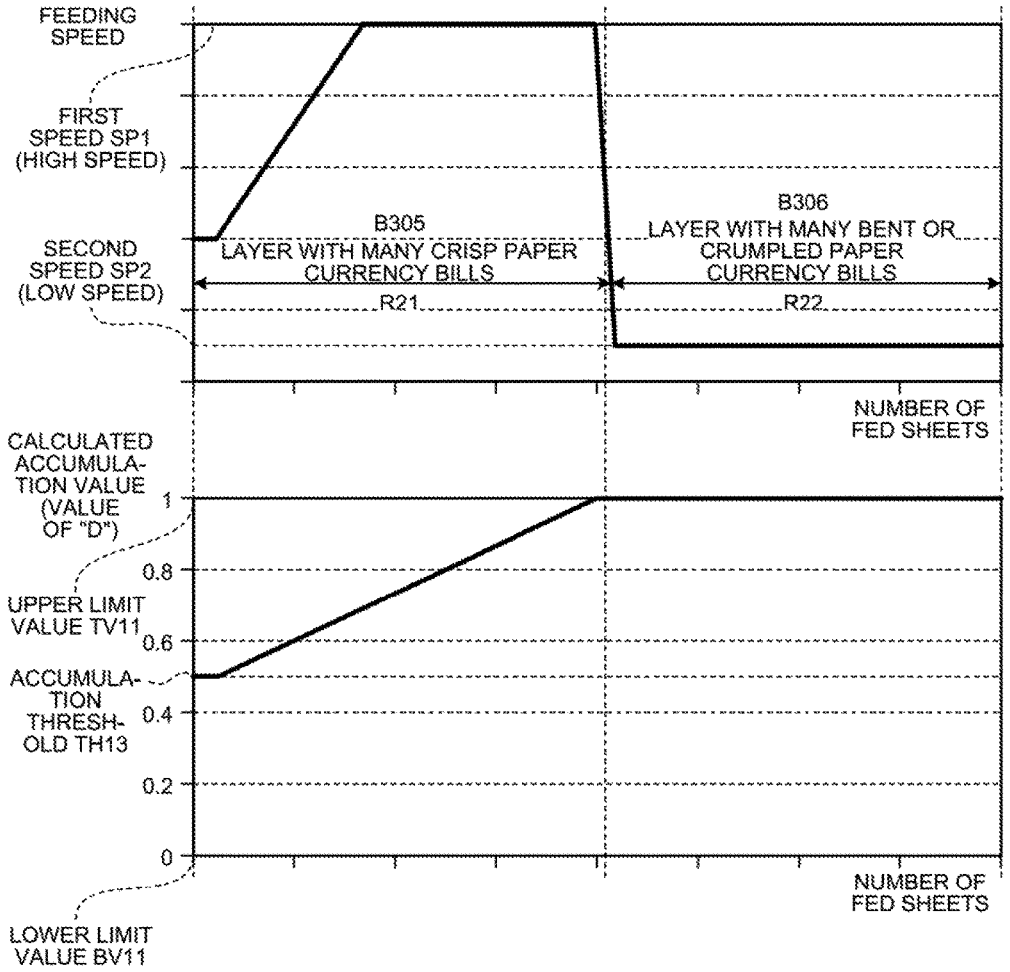
FIG. 13 is a diagram illustrating another example of the process, in which the feeding speed is changed, according to the third embodiment.

Next, FIG. 12 and FIG. 13 illustrate an example, in which less damaged paper currency bills are accumulated at an upper portion of accumulated paper currency bills on the stage 120, and largely damaged paper currency bills are accumulated at a lower portion thereof. FIG. 12 is a diagram illustrating another example of the paper currency bills accumulated in the cassette according to the third embodiment. FIG. 13 is a diagram illustrating another example of the process, in which the feeding speed is changed, according to the third embodiment.

As illustrated in FIG. 12, a paper currency bill bundle B304 on the stage 120 represents a case where a paper currency bill bundle B305 including less damaged paper currency bills is accumulated at an upper portion of the paper currency bill bundle B304 and a paper currency bill bundle B306 including largely damaged paper currency bills is accumulated at a lower portion thereof. FIG. 13 illustrates change in the feeding speed and the calculated accumulation value, in a case where a process based on the procedure illustrated in FIG. 9 is executed when the less damaged paper currency bills are accumulated at the upper portion of the accumulated paper currency bills and the largely damaged paper currency bills are accumulated at the lower portion thereof as illustrated in FIG. 12. In the example illustrated in FIG. 12 and FIG. 13, the upper limit value TV11 is "1", the lower limit value BV11 is "0", and the accumulation threshold TH13 is "0.5". Further, with respect to the example illustrated in FIG. 12 and FIG. 13, the first speed will be described as the first speed SP1 and the second speed as the second speed SP2.

Firstly, in the example illustrated in FIG. 12 and FIG. 13, since the calculated accumulation value is "0.5", which is in a range between the upper limit value TV11 and the lower limit value BV11, the paper sheet handling apparatus 3 starts a feeding process with the feeding speed at a speed selected between the first speed SP1 and the second speed SP2. Thereafter, as illustrated in FIG. 13, since the paper sheet handling apparatus 3 feeds the paper currency bill bundle B305 including the less damaged paper currency bills accumulated at the upper portion, the calculated feeding value becomes less than the feeding threshold TH11. Therefore, the paper sheet handling apparatus 3 gradually increases the feeding speed. Since the calculated accumulation value then exceeds the accumulation threshold TH13, the amount of increase in the feeding speed is made smaller than that in the case where the calculated accumulation value is equal to or less than the accumulation threshold TH13. That is, since the calculated accumulation value exceeds the accumulation threshold TH13 in the feeding process for the paper currency bill bundle B305, which is the layer with many crisp paper currency bills, the paper sheet handling apparatus 3 speeds up more gradually than in the case where the calculated accumulation value is equal to or less than the accumulation threshold TH13, and reaches the first speed SP1. When the feeding speed reaches the first speed SP1, the paper sheet handling apparatus 3 executes the feeding process with the feeding speed at the first speed SP1 if the calculated feeding value is less than the feeding threshold TH11.

In the example illustrated in FIG. 13, an interval R21 represents an interval, in which the paper sheet handling apparatus 3 feeds the paper currency bill bundle B305 including the less damaged paper currency bills. If most of the paper currency bill bundle B305 including the less damaged paper currency bills has been fed, most of the paper currency bill bundle B304 on the stage 120 becomes the paper currency bill bundle B306 including the largely damaged paper currency bills. The calculated accumulation value then reaches, for example, the upper limit value TV11. Therefore, the paper sheet handling apparatus 3 sets the feeding speed to the second speed SP2, and executes the feeding process at a low speed in an interval R22, in which the paper sheet handling apparatus 3 feeds the paper currency bill bundle B306 including the largely damaged paper currency bills. Thereby, the paper sheet handling apparatus 3 increases the feeding speed for the layer having many crisp paper currency bills, and avoids the risk of a jam by immediately dropping the feeding speed for the layer of bent or crumpled paper currency bills. Therefore, the paper sheet handling apparatus 3 enables the possibility of occurrence of damage to the paper currency bills or a conveyance jam to be decreased and the conveyance speed of the paper currency bills to be increased.

[Effects]

The paper sheet handling apparatus 3 according to the third embodiment has the feeding unit (the pickup roller 110 in the third embodiment), the detection unit (the pressure sensor 130 in the third embodiment), the placement unit (the stage 120 in the third embodiment), the measuring unit, and the detecting unit (the position sensor 150 in the third embodiment). The pickup roller 110 feeds paper sheets (paper currency bills in the third embodiment) by rotating. The pressure sensor 130 detects pressure applied on the pickup roller 110. Paper currency bills are layered over one another and accumulated in the thickness direction on the stage 120, and the stage 120 presses the paper currency bills against the pickup roller 110 by moving in the layering direction of the paper currency bills until the pressure detected by the pressure sensor 130 reaches the predetermined set value (the proper set value SV12 in the third embodiment). The measuring unit measures the amount of movement of the stage 120. The position sensor 150 is installed between the pickup roller 110 and the stage 120 in the moving direction of the stage 120, and detects passage of the paper currency bills layered over one another on the stage 120. Further, for each feeding process, in which paper currency bills are fed by the pickup roller 110 until the pressure detected by the pressure sensor 130 becomes less than another set value (the lower limit set value SV11 in the third embodiment), the stage 120 presses the paper currency bills against the pickup roller 110 until the pressure detected by the pressure sensor 130 reaches the proper set value SV12. For the pickup roller 110, a calculated accumulation value is calculated based on: the amount of movement of the stage 120 measured by the measuring unit from when the passage of the paper currency bills is detected by the position sensor 150 to when the pressure detected by the pressure sensor 130 reaches the proper set value SV12; and the number of paper currency bills layered over one another on the stage 120. Further, a calculated feeding value is calculated from: the amount of movement of the stage 120 measured by the measuring unit after the feeding process; and the number of paper currency bills fed by the feeding process. Based on the calculated accumulation value and the calculated feeding value, which have been calculated, the operation is executed at a feeding speed set between the first speed and the second speed that is slower than the first speed. Thereby, since the paper sheet handling apparatus 3 is able to set the feeding speed according to the state of the paper currency bills, the possibility of occurrence of damage to the paper currency bills or a conveyance jam is able to be decreased and the conveyance speed of the paper currency bills is able to be increased.

In the paper sheet handling apparatus 3, based on the calculated accumulation value, which is updated for each feeding process, and the calculated feeding value, the pickup roller 110 operates at the feeding speed set between the first speed and the second speed. Thereby, since the paper sheet handling apparatus 3 is able to set the feeding speed according to the state of the paper currency bills, the possibility of occurrence of damage to the paper currency bills or a conveyance jam is able to be decreased and the conveyance speed of the paper currency bills is able to be increased.

In the paper sheet handling apparatus 3, the pickup roller 110 increases the feeding speed if the calculated feeding value is less than the predetermined threshold for calculated feeding value (the feeding threshold TH11 in the third embodiment) and the feeding speed is less than the first speed, and decreases the feeding speed if the calculated feeding value is equal to or greater than the feeding threshold TH11 and the feeding speed exceeds the second speed. Thereby, since the paper sheet handling apparatus 3 is able to set the feeding speed according to the state of the paper currency bills, the possibility of occurrence of damage to the paper currency bills or a conveyance jam is able to be decreased and the conveyance speed of the paper currency bills is able to be increased.

In the paper sheet handling apparatus 3, when increasing the feeding speed, the pickup roller 110 decreases the change in the feeding speed if the calculated accumulation value exceeds the predetermined threshold for calculated accumulation value (the accumulation threshold TH13 in the third embodiment). Thereby, since the paper sheet handling apparatus 3 is able to set the feeding speed according to the state of the paper currency bills, the possibility of occurrence of damage to the paper currency bills or a conveyance jam is able to be decreased and the conveyance speed of the paper currency bills is able to be increased.

In the paper sheet handling apparatus 3, when decreasing the feeding speed, the pickup roller 110 decreases the change in the feeding speed if the calculated accumulation value is less than the accumulation threshold TH13. Thereby, the paper sheet handling apparatus 3 is able to set the feeding speed according to the state of the paper currency bills. Therefore, the paper sheet handling apparatus 3 enables the possibility of occurrence of damage to the paper currency bills or a conveyance jam to be decreased and the conveyance speed of the paper currency bills to be increased.

In the paper sheet handling apparatus 3, if the calculated accumulation value is equal to or less than the predetermined lower limit value (the lower limit value BV11 in this embodiment), the pickup roller 110 operates at the feeding speed of the first speed. Thereby, the paper sheet handling apparatus 3 immediately increases the feeding speed in the layer with many crisp paper currency bills. Therefore, the paper sheet handling apparatus 3 enables the possibility of occurrence of damage to the paper currency bills or a conveyance jam to be decreased and the conveyance speed of the paper currency bills to be increased.

In the paper sheet handling apparatus 3, if the calculated accumulation value is equal to or greater than the predetermined upper limit value (the upper limit value TV11 in this embodiment), the pickup roller 110 operates at the second speed. Thereby, the paper sheet handling apparatus 3 avoids the risk of a jam by immediately dropping the feeding speed in the layer of bent or crumpled paper currency bills. Therefore, the paper sheet handling apparatus 3 enables the possibility of occurrence of damage to the paper currency bills or a conveyance jam to be decreased and the conveyance speed of the paper currency bills to be increased.

Without special hardware, existing devices may be used as they are and applied inexpensively to the first embodiment. Further, existing devices may be easily applied to the second and third embodiments also, by addition of the position sensor 150 to the existing devices and change to the program.

The present invention is not limited to the above described embodiments as they are, and may be embodied by modification of their components without departing from the substance thereof upon their implementation. Further, by appropriate combination of any components disclosed by the above described embodiments, various inventions may be formed. For example, all of the components disclosed by the embodiments may be combined as appropriate. Furthermore, the components of different ones of the embodiments may be combined as appropriate. Various modifications and applications may of course be made without departing from the gist of the invention.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet handling apparatus, comprising:

a feeding unit that feeds paper sheets by rotating;

a placement unit, on which the paper sheets are layered over one another and accumulated in a thickness direction, and which presses the paper sheets against the feeding unit by moving in a layering direction of the paper sheets; and a detection unit that detects pressure applied on the feeding unit due to movement of the placement unit; and a measuring unit that measures amount of movement of the placement unit, wherein for each feeding process, in which the feeding unit feeds the paper sheets until the pressure detected by the detection unit becomes less than a predetermined set value, the placement unit presses the paper sheets against the feeding unit until the pressure detected by the detection unit reaches another set value, and the feeding unit operates at a feeding speed of a first speed if a calculated feeding value is less than a predetermined threshold for the calculated feeding value, and operates at the feeding speed of a second speed that is slower than the first speed if the calculated feeding value is equal to or greater than the predetermined threshold for the calculated feeding value, the calculated feeding value being calculated based on:

the amount of movement of the placement unit measured by the measuring unit after the feeding process; and the number of fed sheets that is the number of paper sheets fed by the feeding process.

2. The paper sheet handling apparatus according to claim 1, wherein the feeding unit operates at the feeding speed of the first speed if an average value of the respective calculated feeding values for plural feeding processes is less than the predetermined threshold for the calculated feeding value, and operates at the feeding speed of the second speed if the average value is equal to or greater than the predetermined threshold for the calculated feeding value.

3. The paper sheet handling apparatus according to claim 1, further comprising:

a detecting unit that is installed between the feeding unit and the placement unit in a moving direction of the placement unit, and that detects passage of paper sheets layered over one another on the placement unit, wherein the feeding unit starts operation at the feeding speed of the first speed if a calculated accumulation value is less than a predetermined threshold for the calculated accumulation value, and starts operation at the feeding speed of the second speed if the calculated accumulation value is equal to or greater than the predetermined threshold for the calculated accumulation value, the calculated accumulation value being calculated based on:

the amount of movement of the placement unit measured by the measuring unit from when passage of the paper sheets is detected by the detecting unit to when the pressure detected by the detection unit reaches a predetermined value; and the number of paper sheets layered over one another on the placement unit.

4. A paper sheet handling apparatus, comprising:

a feeding unit that feeds paper sheets by rotating;

a detection unit that detects pressure applied on the feeding unit;

a placement unit, on which the paper sheets are layered over one another and accumulated in a thickness direction, and which presses the paper sheets against the feeding unit by moving in a layering direction of the paper sheets until the pressure detected by the detection unit reaches a predetermined set value;

a measuring unit that measures amount of movement of the placement unit; and a detecting unit that is installed between the feeding unit and the placement unit in a moving direction of the placement unit, and that detects passage of paper sheets layered over one another on the placement unit, wherein for each feeding process, in which the feeding unit feeds the paper sheets until the pressure detected by the detection unit becomes less than another set value, the placement unit presses the paper sheets against the feeding unit until the pressure detected by the detection unit reaches the predetermined set value, and the feeding unit operates at a feeding speed that is set between a first speed and a second speed that is slower than the first speed, based on a calculated accumulation value and a calculated feeding value, the calculated accumulation value being calculated based on:

the amount of movement of the placement unit measured by the measuring unit from when passage of the paper sheets is detected by the detecting unit to when the pressure detected by the detection unit reaches the predetermined set value; and the number of paper sheets layered over one another on the placement unit, the calculated feeding value being calculated from:

the amount of movement of the placement unit measured by the measuring unit after the feeding process; and the number of fed sheets that is the number of paper sheets fed by the feeding process.

5. The paper sheet handling apparatus according to claim 4, wherein based on the calculated accumulation value that is updated for each feeding process and the calculated feeding value, the feeding unit operates at the feeding speed that is set between the first speed and the second speed.

6. The paper sheet handling apparatus according to claim 4, wherein the feeding unit increases the feeding speed if:

the calculated feeding value is less than a predetermined threshold for the calculated feeding value; and the feeding speed is less than the first speed, and decreases the feeding speed if:

the calculated feeding value is equal to or greater than the predetermined threshold for the calculated feeding value; and the feeding speed exceeds the second speed.

7. The paper sheet handling apparatus according to claim 6, wherein when the feeding unit increases the feeding speed, the feeding unit decreases change in the feeding speed if the calculated accumulation value exceeds a predetermined threshold for the calculated accumulation value.

8. The paper sheet handling apparatus according to claim 6, wherein when the feeding unit decreases the feeding speed, the feeding unit decreases change in the feeding speed if the calculated accumulation value is less than a predetermined threshold for the calculated accumulation value.

9. The paper sheet handling apparatus according to claim 6, wherein the feeding unit operates at the feeding speed of the first speed if the calculated accumulation value is equal to or less than a predetermined lower limit value.

10. The paper sheet handling apparatus according to claim 6, wherein the feeding unit operates at the feeding speed of the second speed if the calculated accumulation value is equal to or greater than a predetermined upper limit value.

11. A paper sheet handling apparatus, comprising:

a feeding unit that feeds paper sheets by rotating;

a detection unit that detects pressure applied on the feeding unit;

a placement unit, on which the paper sheets are layered over one another and accumulated in a thickness direction, and which presses the paper sheets against the feeding unit by moving in a layering direction of the paper sheets until the pressure detected by the detection unit reaches a predetermined set value;

a measuring unit that measures amount of movement of the placement unit; and a detecting unit that is installed between the feeding unit and the placement unit in a moving direction of the placement unit, and that detects passage of paper sheets layered over one another on the placement unit, wherein the feeding unit operates at the feeding speed of a first speed if a calculated accumulation value is less than a predetermined threshold for the calculated accumulation value, and operates at the feeding speed of a second speed that is slower than the first speed if the calculated accumulation value is equal to or greater than the predetermined threshold for the calculated accumulation value, the calculated accumulation value being calculated based on:

the amount of movement of the placement unit measured by the measuring unit from when passage of the paper sheets is detected by the detecting unit to when the pressure detected by the detection unit reaches the predetermined set value; and the number of paper sheets layered over one another on the placement unit.

* * * * *